US006435639B1

(12) United States Patent
Nakajima et al.

(10) Patent No.: US 6,435,639 B1
(45) Date of Patent: Aug. 20, 2002

(54) INK JET RECORDING METHOD AND INK JET RECORDING APPARATUS

(75) Inventors: Yoshinori Nakajima; Toshiharu Inui, both of Yokohama; Daigoro Kanematsu, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/299,650

(22) Filed: Apr. 27, 1999

(30) Foreign Application Priority Data

| | | |
|---|---|---|
| Apr. 27, 1998 | (JP) | 10-116902 |
| May 28, 1998 | (JP) | 10-147823 |
| Jul. 3, 1998 | (JP) | 10-189369 |

(51) Int. Cl.[7] ..... B41J 2/21
(52) U.S. Cl. ..... 347/15
(58) Field of Search ..... 347/12, 13, 15, 347/41–43, 96, 98, 101

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,459,600 | A | 7/1984 | Sato et al. |
| 4,463,359 | A | 7/1984 | Ayata et al. |
| 4,558,333 | A | 12/1985 | Sugitani et al. |
| 4,608,577 | A | 8/1986 | Hori |
| 4,723,129 | A | 2/1988 | Endo et al. |
| 4,740,796 | A | 4/1988 | Endo et al. |

FOREIGN PATENT DOCUMENTS

| | | |
|---|---|---|
| JP | 54-56847 | 5/1979 |
| JP | 56-84992 | 7/1981 |
| JP | 58-128862 | 8/1983 |
| JP | 59-123670 | 7/1984 |
| JP | 59-138461 | 8/1984 |
| JP | 60-71260 | 4/1985 |
| JP | 64-63185 | 3/1989 |
| JP | 3-146355 | 6/1991 |
| JP | 4-158049 | 6/1992 |
| JP | 7-195823 | 8/1995 |
| JP | 8-39795 | 2/1996 |
| JP | 8-52867 | 2/1996 |
| JP | 9-226154 | 9/1997 |

*Primary Examiner*—John Barlow
*Assistant Examiner*—Michael S Brooke
(74) *Attorney, Agent, or Firm*—Fitzpatrick, Cella, Harper & Scinto

(57) ABSTRACT

An ink jet recording apparatus that avoids application of a treatment fluid to ink in an amount more than necessary and shows a sufficient treatment fluid effect is provided when a data generator for the treatment fluid generates the treatment fluid data using a selected mask pattern in accordance with the image data binarized by a binarizing unit. The ink jet recording apparatus generates print data based on the image data and the treatment fluid data, applies the ink and treatment fluid onto a recording material, and performs recording.

22 Claims, 30 Drawing Sheets

QUANTIZED COLOR DATA — TREATMENT FLUID DATA TABLE

FIG. 18A

| DY | DSY |
|---|---|
| LEVEL 0 | LEVEL 0 |
| LEVEL 1 | LEVEL 1 |
| LEVEL 2 | LEVEL 2 |
| LEVEL 3 | LEVEL 2 |
| LEVEL 4 | LEVEL 2 |

FIG. 18B

| DM | DSM |
|---|---|
| LEVEL 0 | LEVEL 0 |
| LEVEL 1 | LEVEL 1 |
| LEVEL 2 | LEVEL 2 |
| LEVEL 3 | LEVEL 2 |
| LEVEL 4 | LEVEL 2 |

FIG. 18C

| DC | DSC |
|---|---|
| LEVEL 0 | LEVEL 0 |
| LEVEL 1 | LEVEL 1 |
| LEVEL 2 | LEVEL 2 |
| LEVEL 3 | LEVEL 2 |
| LEVEL 4 | LEVEL 2 |

FIG. 18D

| DK | DSK |
|---|---|
| LEVEL 0 | LEVEL 0 |
| LEVEL 1 | LEVEL 1 |
| LEVEL 2 | LEVEL 2 |
| LEVEL 3 | LEVEL 3 |
| LEVEL 4 | LEVEL 4 |

FIG. 18E

| Dmax | DS |
|---|---|
| LEVEL 0 | LEVEL 0 |
| LEVEL 1 | LEVEL 1 |
| LEVEL 2 | LEVEL 2 |
| LEVEL 3 | LEVEL 2 |
| LEVEL 4 | LEVEL 2 |

FIG. 19

| Dmax | WHERE DS=DSK | WHERE DS=DSY, DSM OR DSC |
|---|---|---|
| LEVEL 0 | | |
| LEVEL 1 | BLACK DOT (BK1 DOT+BK2 DOT)<br>TREATMENT FLUID DOT | COLOR DOT (Y, M, C)<br>TREATMENT FLUID DOT |
| LEVEL 2 | BLACK DOT<br>BLACK DOT<br>TREATMENT FLUID DOT<br>TREATMENT FLUID DOT | COLOR DOT<br>COLOR DOT<br>TREATMENT FLUID DOT<br>TREATMENT FLUID DOT |
| LEVEL 3 | BLACK DOT<br>TREATMENT FLUID DOT<br>TREATMENT FLUID DOT<br>TREATMENT FLUID DOT | COLOR DOT<br>COLOR DOT<br>TREATMENT FLUID DOT<br>TREATMENT FLUID DOT |
| LEVEL 4 | TREATMENT FLUID DOT<br>BLACK DOT<br>BLACK DOT<br>TREATMENT FLUID DOT | COLOR DOT<br>COLOR DOT<br>TREATMENT FLUID DOT |

FIG. 28

41

| | A | B | C | D | E | F | G | H |
|---|---|---|---|---|---|---|---|---|
| 1 | 191 | 64 | 128 | 239 | 92 | 12 | 60 | 187 |
| 2 | 143 | 0 | 48 | 112 | 219 | 171 | 108 | 235 |
| 3 | 80 | 32 | 16 | 175 | 195 | 68 | 132 | 243 |
| 4 | 207 | 159 | 96 | 223 | 147 | 36 | 20 | 116 |
| 5 | 199 | 72 | 135 | 247 | 84 | 4 | 52 | 179 |
| 6 | 151 | 8 | 56 | 120 | 211 | 163 | 100 | 227 |
| 7 | 88 | 40 | 24 | 183 | 203 | 76 | 139 | 251 |
| 8 | 215 | 167 | 104 | 231 | 155 | 44 | 28 | 124 |

FIG. 36

| | | | |
|---|---|---|---|
| YELLOW 255 GRADA-TIONS | RED 255 GRADA-TIONS | YELLOW 255 GRADA-TIONS | BLUE 255 GRADA-TIONS |
| RED 255 GRADA-TIONS | YELLOW 255 GRADA-TIONS | BLUE 255 GRADA-TIONS | YELLOW 255 GRADA-TIONS |
| CYAN 255 GRADA-TIONS | GREEN 255 GRADA-TIONS | CYAN 255 GRADA-TIONS | GREEN 255 GRADA-TIONS |
| RED 255 GRADA-TIONS | CYAN 255 GRADA-TIONS | BLUE 255 GRADA-TIONS | CYAN 255 GRADA-TIONS |

64 DOTS

64 DOTS

INK JET RECORDING METHOD AND INK JET RECORDING APPARATUS

BACKGROUND OF THE INVENTION

1. Field of the Invention

The present invention relates to an ink jet recording method and an ink jet recording apparatus.

2. Related Background Art

Because ink jet recording apparatuses which can perform recording on recording media such as paper, cloth, plastics and sheets for OHP enable a high-density and high-speed recording operation, they have been widely used and commercialized as information processing systems, for example, printers as output means for copiers, facsimile machines, teletypewriters, word processors and workstations, or handy or portable printers for personal computers, host computers, optical disk equipment, and video/visual equipment.

In general, such an ink jet recording apparatus mainly comprises a carriage on which a recording head unit consisting of a recording head and an ink tank is mounted, a means that transports a recording medium, and a control means for controlling them. In this configuration, recording can be performed on the recording medium by serially scanning the recording head in the direction (hereinafter referred to as main scanning direction) vertically intersecting the transport direction (hereinafter referred to as sub scanning direction) of the recording medium and discharging ink drops from a plurality of discharge outlets of the recording head during this scan. Then, when this one-line recording is terminated, the recording medium is intermittently transported only by a predetermined amount. Further, an ink jet recording apparatus having a recording head, in which a plurality of discharge outlets which discharge ink drops are aligned in the sub scanning direction, has also been developed, and this ink jet recording apparatus can perform recording of a width (normally, a width of the head) that corresponds to the number of discharge outlets in one scan.

Because the ink jet recording apparatus described above performs recording by discharging ink drops, its running cost is cheap and its operation is also quiet. Because the ink jet recording apparatus can perform recording for the width of the head in one scan, it also enables a high-speed recording operation and has been widely used.

Further, a color ink jet recording apparatus equipped with 3- or 4-color recording heads, in which discharge outlets are aligned in the sub scanning direction, is also put to practical use. This ink jet recording apparatus installs four types of recording heads and ink tanks which correspond to three primary colors of yellow (Y), magenta (M) and cyan (C) or the four colors including black (B) in addition to these three primary colors, and can form a full-color image by the conventional ink jet recording method. Furthermore, in recent years, an ink jet recording apparatus, in which recording heads, which also discharge a lower density ink than each ink in addition to Y, M and C, inks are also installed and which enable representation of a smoother graduation, has also been developed.

Thus, an ink jet recording apparatus in which the single unit is used to enable formation of both a full-color image and only a black image such as a character is becoming the mainstream.

Hereupon, when a color image is formed on plain paper by the ink jet recording method, because the prevention of an ink blot in the boundary region of each color of black, yellow, magenta, and cyan and the prevention of the high density and feathering of a black image are conflicting issues, it is very difficult to obtain a high-density image having no ink blot and feathering.

This is because ink is prevented from blotting in the boundary region of each color by using quick-drying ink of which permeation rate into a plain paper is fast when a color image is recorded on the plain paper by the ink jet recording method. However, when the quick-drying ink is used, a black image is low in its density and a colored image part other than the black image has low color development. Moreover, because the quick-drying ink is easy to permeate along a paper fiber, feathering is easy to generate. In particular, characters printed in black are conspicuous in feathering and become unclear characters short of sharpness as compared with those printed in other colors. As a result, the quality of an image deteriorates greatly on the whole.

Accordingly, to obtain a high quality image with density of a black image part that is high and which causes no feathering, a method is sometimes used in which much ink, the permeation of which into plain paper is comparatively slow, is applied to the same location. However, because this method is slow in the permeation of each ink into paper, it conversely generates a blot. In particular, in the boundary area between a black image part and a color image part, a blot in black ink and color ink is generated and the quality of an image deteriorates greatly.

To improve these defects, an ink jet recording method of installing a heater in a recording apparatus, accelerating the drying of ink, and obtaining a blot-free color image having high color development between colors is also put to practical use. However, because this method installs a heater capable of drying ink in the recording apparatus, the unit becomes larger and more expensive.

Then, as described in Japanese Patent Application Laid-open No. 3-146355, a method of performing no printing in the area along the boundary area between the black image part and color image part is proposed. However, this method has a defect that data to be printed may change when an image is formed.

Further, as described in the Japanese Patent Application Laid-open No. 4-158049, a method of performing recording by installing a plurality of color heads for color recording and a head for character recording and switching the plurality of color heads and the head for character recording based on recorded data is proposed. Because in this method the black ink of the head for color recording and the black ink of the head for character recording differ, if a black image recorded by the head for color recording and a black image recorded by the head for character recording coexist, a sense of incompatibility caused by the quality difference of both images is generated.

Furthermore, a method of preventing a blot in the boundary region between a black image part and a color image part is taken into consideration by overlappingly applying three-color ink of Y, M and C to form a black image without performing printing with black ink in a fixed black area along the boundary between the black image part and color image part. However, the black image formed by overlappingly applying the three-color ink of Y, M and C has worse color development than the black image formed with only normal black ink.

On the other hand, as described in the Japanese Patent Application Laid-open No. 56-84992 and the Japanese Patent Application Laid-open No. 64-63185, a method of preventing a blot and feathering using a fluid which insolubilizes dyes is also proposed. In other words, because the fluid that insolubilizes the dyes and ink are mixed and fused on a recording medium, the ink is not permeated into the recording medium and the blot and feathering can be prevented.

The ink jet recording method described in Japanese Patent Application Laid-open No. 56-84992 is used to coat recording paper with a material for previously fixing the dyes. However, when printing is performed by this method, specific recording paper must be used, and to coat it with the material for previously fixing the dyes, the unit becomes larger and more expensive. Further, it is difficult to evenly coat the recording paper with the aforementioned material at a predetermined film thickness.

Moreover, as described in the Japanese Patent Application Laid-open No. 64-63185, there is also a method of making the colorless ink that insolubilizes the dyes adhere on a recording medium by an ink jet recording head.

Because this method makes the dot diameter of aforementioned colorless ink larger than the dot diameter of the ink for an image, desired characteristics can be satisfied even if the impact position between the image ink and the colorless ink is shifted. However, because the amount of colorless ink printed on the part that corresponds to the image position normally becomes larger than the amount of the image ink applied, there are such problems to be solved that the drying time of the ink is not only prolonged but an image becomes exceedingly unclear.

Further, in Japanese Patent Application Laid open No. 7-195823, by applying the previously described colorless ink to the surface of a recording medium prior to the ink jet recording, the color print can be obtained in one pass.

The methods disclosed in each of the aforementioned publications all have problems to be solved. Because the colorless ink described previously insolubilizes the dyes in ink, the ink blot may be prevented from forming between respective colors when this method is applied to color recording.

The applicant of this patent has solved the aforementioned problems, and proposes an ink jet recording method whereby a fluid which insolubilizes dyes is used. The amount of consumption of this fluid is suppressed to the utmost, and as a result a low running cost is realized, more excellent water resistance (or imperviousness to water) than before is shown even on plain paper, a high density image can be obtained, and an image of high color development with no blot between colors is produced when the method is applied to color recording (Japanese Patent Application Laid-open No. 8-39795).

Furthermore, to obtain high density images, a method of performing recording on a recording medium at three stages is used. These stages comprise a first stage where ink is discharged to a predetermined area, a second stage where the fluid which insolubilizes the dyes in the ink is discharged to the predetermined area, and a third stage where the ink having the same color as in the first stage is discharged to the predetermined area. Accordingly, an image with high density and clear contrast can be obtained by applying a greater amount of ink on the whole as compared with the image by the conventional method.

However, when the conventional ink jet recording method described above is used, the following problem arises.

In other words, because the ink applied onto the recording medium at the first stage and the treatment fluid applied at the second stage react, the ink is non-liquefied, and the ink is applied at the third stage, the time required for permeation and the time required for fixing become prolonged. This problem interrupts a high-speed recording operation.

If the image density satisfies a fixed level, even a light density among the densities is not inferior on visual inspection so long as it exceeds the predetermined level.

Moreover, in recent years, to obtain a higher quality image, high resolution has been obtained by forming recording fluid drops as small fluid drops. However, in order to achieve such high resolution, the recording data size to be processed reaches a great amount, the data processing time in a host computer and the transfer time of the data transferred from the host computer to a recording apparatus are prolonged, and the throughput of the entire system is greatly reduced.

To solve this problem, a method of performing recording using a matrix pattern is taken into consideration. This method transfers the data processed at comparatively low resolution and high-value quantized by a host computer to a printer main body and performs recording by developing received data into a predetermined matrix using the printer main body. For example, recording is performed by quantizing (3 bits) data into quinary values at a resolution of 300 by 300 dpi using the host computer and by developing to a binary value of 600 by 600 dpi (a matrix of 2 by 2) using the printer main body, whereby the host computer processing becomes 300 dpi and accordingly its load is reduced. Also, because the data transfer is 300 by 300 dpi, 3 bits, an advantage of thinning the data amount to about 75% is obtained as compared with the 600 by 600 dpi, binary data. Such method of using the matrix pattern is effective for an image such as a photograph wherein emphasis is laid on graduation rather than sharpness.

Hereupon, in the ink jet recording method, when an image is recorded on a recorded material called the so-called plain paper, the water resistance of the image is insufficient, and for the recording of a color image, a high-density image causing no feathering and an image causing no blot between colors cannot coexist, and the color image with good image fastness properties and good quality is not obtained.

In recent years, as a method of improving the water resistance of an image, an ink having a water resistance in the color material contained therein has also been put to practical use. However, because the ink is still insufficiently water resistant, and is difficult to dissolve in water after drying, the nozzle clogging of a recording head, that is, the clogging of an ink discharge outlet, is likely to occur. To prevent this, the configuration of the apparatus becomes complicated.

Further, many technological developments for improving the fastness properties of a recorded material have been proposed. For example, in Japanese Patent Application Laid-open No. 58-128862, an ink jet recording method of previously recognizing the position of an image to be recorded on the recorded material and performing recording by overlapping recording ink and treatment ink has been devised. In that method, an image is drawn by the treatment ink prior to the recording ink, the treatment ink is overlapped on the image of the recording ink drawn previously, and after overlapping of the recording ink on the image of the treatment ink drawn previously, the treatment ink is further overlapped. Further, in Japanese Patent Application Laid-open No. 8-52867, a method of discharging the treatment fluid to each pixel at a predetermined ratio is disclosed. Further, in Japanese Patent Application Laid-open No. 9-226154, special attention is paid to the edge part of an image to be printed, and there is disclosed a configuration that the treatment fluid is discharged to the image other than the edge part at a predetermined ratio while the treatment fluid is always discharged to the edge part of the image, whereby the treatment fluid is prevented from being consumed more than necessary and the water resistance is made more accurate.

As disclosed in Japanese Patent Application Laid-open No. 9-226154, to apply an effective treatment fluid, the edge part of an image to be printed is selected, and the treatment liquid is applied to the image of the edge part and the image other than the edge part at respective predetermined ratios. However, for this invention a very complicated and large-scale circuit configuration is needed as an electrical hardware means, which results in an increased cost. Also, to perform such processing on a software basis, a non-realistic enormous amount of time would be required for a high-resolution recording apparatus.

Further, to apply an effective treatment fluid to a boundary, the edge part of an image to be printed is selected and the treatment fluid is applied to the image of the edge part and the image other than the edge part at respective predetermined ratios, so that a very complicated and large-scale circuit configuration is needed as an electrical hardware means, which results in an increased cost. Then, to perform the aforementioned processing on a software basis, an unrealistic enormous amount of time would be required for a high-resolution recording apparatus.

SUMMARY OF THE INVENTION

A first object of the present invention is to provide ink jet recording method/apparatus for solving the conventional technical issues described above, preventing the fixing time of ink from being prolonged without considerably decreasing the density of an image, and enabling a high-speed recording operation.

To attain the first object described previously, an ink jet recording method of the present invention is provided in an ink jet recording apparatus which comprises a first head having a discharge outlet which discharges a first ink showing a first color, a second head having a discharge outlet which discharges a second ink showing the same color as the first color, and a third head having a discharge outlet which discharges a treatment fluid that insolubilizes the first ink and the second ink, wherein when an image is formed by discharging the ink or treatment fluid to an area where recording is performed according to the same image data, in the order of the first head, the third head, and the second head, based on the same image data, and regardless of said same image data, the application amount X1 of the first head for the area and the application amount X2 of the second head for the second head are set to X1<X2 or X1>X2.

To attain the first object described previously, an ink jet recording apparatus of the present invention comprises a first head having a discharge outlet which discharges a first ink showing a first color, a second head having a discharge outlet which discharges a second ink showing the same color as the first color, and a third head having a discharge outlet which discharges a treatment fluid that insolubilizes the first ink and the second ink, wherein when an image is formed by discharging the ink or treatment fluid to an area where recording is performed according to the same, in the order of the first head, the third head, and the second head, based on the same image data, and the application amount X1 of the first head for the area and the application amount X2 of the second head for the second head are set to X1<X2 or X1>X2.

The configuration described above decreases the entire amount of application to a recording medium, and as a result, can reduce the fixing time.

Further, a second object of the present invention is to provide an ink jet recording apparatus and an ink jet recording method which generates the treatment fluid quantized data from n-valued ink quantized data and performs recording using the so-called matrix pattern method based on these data, whereby an electrical hardware cost is suppressed, the increase of the software processing time is prevented, sufficient water resistance is obtained by applying a sufficient amount of treatment fluid, the increase of the running cost due to the increase of the amount of treatment fluid used can be prevented by avoiding the application of treatment fluid more than is necessary.

To attain the second object, an ink jet recording apparatus of the present invention, in addition to the aforementioned ink jet recording apparatus, further comprises a means which generates the treatment fluid quantized data based on the ink quantized data n-valued at predetermined resolution, a means which allocates the ink data and treatment fluid data using a matrix consisting of a plurality of pixels, based on the ink quantized data and the treatment fluid quantized data, a first control means which controls the discharge of the ink by the ink head unit for a pixel subject to the allocation, based on the ink data allocated by the allocating means, and a second control means which controls the discharge of treatment fluid by the treatment fluid head unit for a pixel subject to the allocation, based on the treatment fluid data allocated by the allocating means.

Further, to attain the second object, the ink jet recording method, in addition to aforementioned ink jet recording method, further comprises the steps of generating treatment quantized data based on the ink quantized data n-valued at predetermined resolution, allocating the ink data and the treatment fluid data using a matrix consisting of a plurality of pixels according to the ink quantized data and treatment fluid quantized data, controlling the discharge of ink by the ink head unit for the pixel subjected to the allocation, based on the allocated ink data, and controlling the discharge of the treatment fluid by the treatment fluid head unit for the pixel subject to the allocation, based on the allocated fluid data.

Furthermore, a third object of the present invention is to-prevent the increase of the running cost due to the increase in the amount of treatment fluid used by generating the treatment fluid data from the ink data binarized based on a pattern predetermined per density and is to apply an amount of treatment fluid enough to obtain the effect of treatment fluid by generating the treatment fluid data based on the pattern of the binary ink data that can be estimated per density.

The ink jet recording apparatus of the present invention, so as to attain the third object, performs recording by relatively scanning, across a recorded material, a record head equipped with an ink discharge unit and a treatment fluid discharge unit which discharges the treatment fluid acting on the ink by making contact with the ink, and comprises ink data generating means which generates binary data for the ink using a predetermined pattern regarding a predetermined area, treatment fluid data generating means for generating treatment fluid data based on the ink data, and a recording control means which controls discharge of the ink and the treatment fluid to the pixel to be applied, based on the ink data binarized by the ink data generating means and the treatment fluid data generated in the treatment fluid data generating means. The treatment fluid data generating means generates the treatment fluid data for applying the treatment fluid to the same place where the ink is applied, based on the binary ink data when the density in the predetermined area is below a predetermined density, and generates the treatment fluid data so that a thinned amount of the treatment fluid may be applied to the place where the ink is applied, based on the binary ink data when the density of the predetermined area is larger than a predetermined density value.

Additionally, according to the present invention, a treatment fluid acts on ink by making contact with the ink, for example, and contains a component having the action by which color agents in the ink are insolubilized or cohered. Such fluid can show an effect of improving printability, such as improvement in the water resistance of a recorded image, increase of density, prevention of a blot, and reduction of feathering.

BRIEF DESCRIPTION OF THE DRAWINGS

FIGS. 18A, 18B, 18C, 18D and 18E are explanatory diagrams of the data conversion table according to the embodiment of the present invention.

FIG. 19 is a layout diagram of the ink dot and treatment fluid dot according to the fourth embodiment of the present invention.

FIG. 28 is a pattern used for binarization according to the seventh embodiment of the present invention.

FIG. 36 is an input image used according to the seventh embodiment of the present invention.

DETAILED DESCRIPTION OF THE PREFERRED EMBODIMENTS

I. An object of the present invention is to improve the image quality in one pass printing, to reduce the fixing time for high-quality images, and to increase printing speed. The present invention derived to attain the first object is described below.

(a) A first stage at which black ink is discharged, a second stage at which the ink (treatment fluid) that insolubilizes dyes is discharged, and a third stage at which the black ink is discharged are provided, wherein scanning is performed in the main scanning direction which vertically intersects a discharge outlet array based on print data, and recording is performed in the predetermined area of a recording medium. Then, the application amount of ink discharged at the first stage is adjusted by thinning the print data, and reduction of the fixing time is attained accordingly. On the other hand, a high-density image with excellent image quality and a sharp edge is obtained.

(b) A first stage at which black ink is discharged, a second stage at which the ink that insolubilizes dyes is discharged, and a third stage at which the black ink is discharged are provided, wherein scanning is performed in the main scanning direction which vertically intersects a discharge outlet array based on print data, and recording is performed in the predetermined area of a recording medium. Then, the application amount of ink discharged at the third stage is adjusted by thinning the print data, and reduction of the fixing time is attained accordingly. On the other hand, a high-density image with excellent image quality and a sharp edge is obtained.

(c) In Embodiments 1 and 2, the application amount of ink discharged at the first stage or third stage is adjusted according to the discharge amount and the reduction of the fixing time is attained accordingly. On the other hand, a high-density image with excellent image quality and a sharp edge is obtained.

(d) Although in the aforementioned embodiments black ink is used, the same effect is also realized for the color inks, cyan, magenta, and yellow.

The present invention is described below in detail with reference to the drawings.

Figure 1:
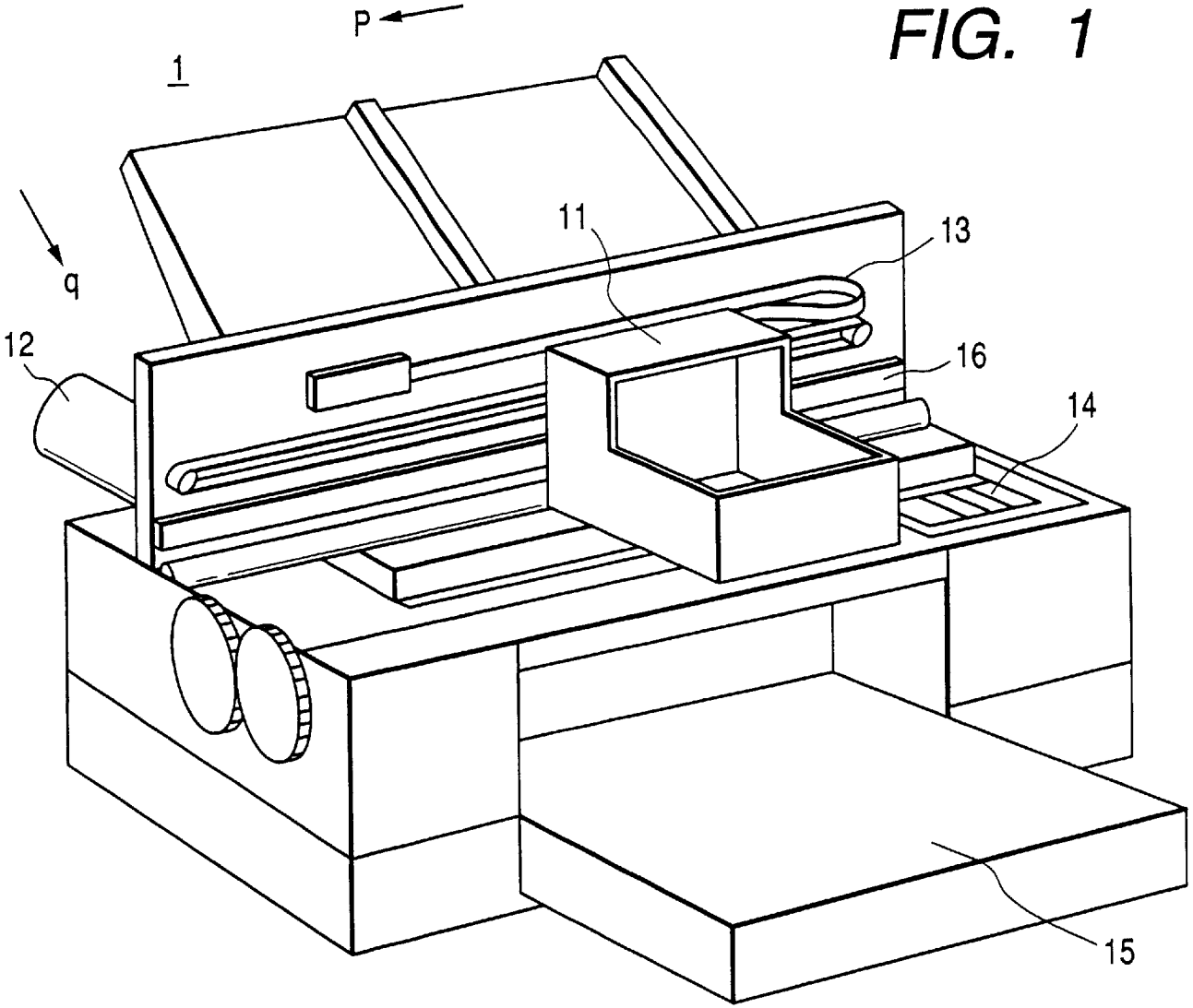
FIG. 1 is a perspective diagram of an ink jet recording apparatus.
Figure 2:
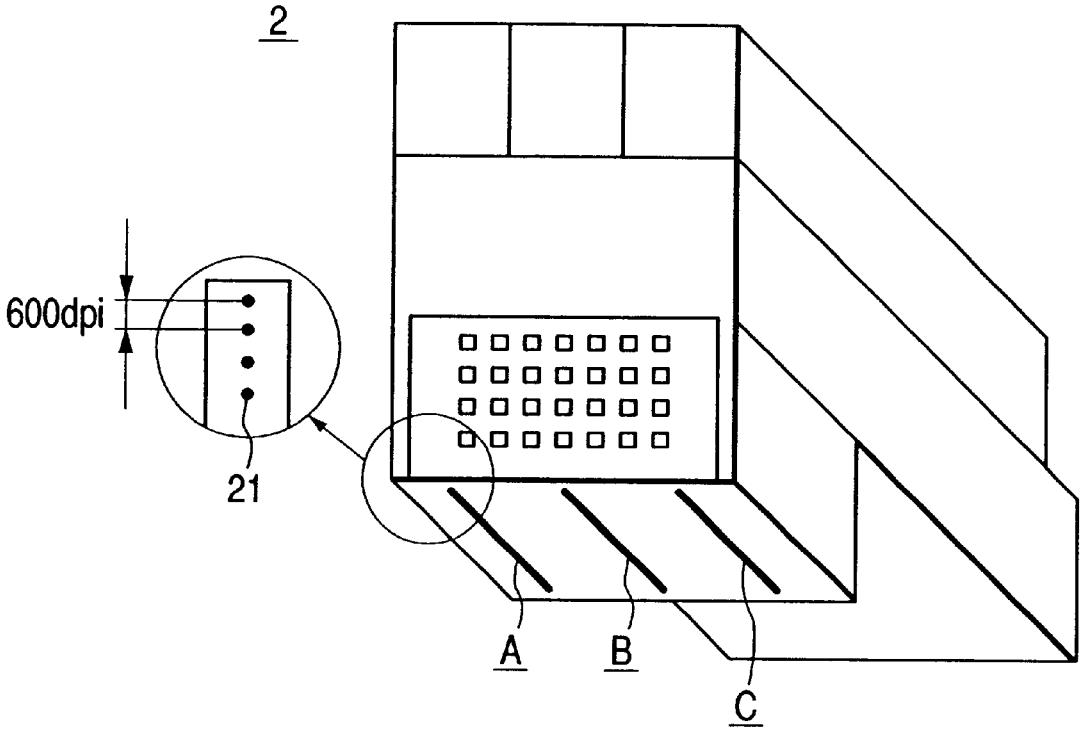
FIG. 2 is a perspective diagram of a recording head unit.

FIG. 1 is a perspective diagram of an ink jet recording apparatus 1 which uses the ink jet recording method of the present invention. FIG. 2 is a perspective diagram of a recording head unit 2 installed in the ink jet recording apparatus 1.

The ink jet recording apparatus 1 has a carriage 11 which installs an ink jet cartridge (not shown), a carriage drive motor 12 which scans and moves the carriage 11, a flexible cable 13 for sending an electrical signal from a control unit (not shown) to the ink jet cartridge, a recovery means 14 for performing the recovery processing of the recording head unit 2 provided in the ink jet cartridge, a paper feed tray 15 which stores a recording medium such as paper in a layered state, and an optical type position sensor 16 which optically reads the position of the cartridge 11.

The recording head unit 2 comprises three heads, and each head has 256 discharge outlets 21. Each discharge outlet 21 is aligned for each head and the nozzle pitch is 600 dpi. Among the three heads (hereinafter referred to as "discharge outlet lines"), black ink is discharged from a discharge outlet array A, the fluid (hereinafter referred to as "treatment fluid") which insolubilizes dyes is discharged from a discharge outlet array B, and black ink is discharged from a discharge outlet array C, respectively. The amount of discharge of each discharge outlet is about 18 ng.

The ink jet recording apparatus in this example adopts a recording method of discharging ink from the discharge outlet 21 by arranging an electricity/heat conversion element corresponding to the discharge outlet 21 and applying a drive signal which corresponds to recording information to the electricity/heat conversion element.

Each electricity/heat conversion element (hereinafter referred to as "heating element") is arranged so as to be able to generate heat independently. Then, due to the heat output of this heating element, a bubble is generated in the ink in proximity to the heating element heated quickly against film boiling, the ink near the discharge outlet 21 by the pressure of this generated bubble is pushed out and discharged toward a recording medium, and characters and images are formed.

Because the recording method which uses the electricity/heat conversion element forms a bubble by applying thermal energy when an ink drop is discharged, it is normally called bubble jet recording.

The ink jet apparatus 1 having such configuration serially scans the carriage 11 in the main scanning direction (direction indicated by an arrow view p) which intersects the transport direction (direction indicated by an arrow view q, hereinafter called sub scanning direction) of a recording medium and performs printing by discharging predetermined ink from each discharge outlet 21 in the recording head unit 2. Because printing is performed in one pass in the main scanning direction, printing can be performed in the single scan only for the width of the discharge outlet line. Also, the recording medium is intermittently transported in the sub scanning direction only by predetermined amount in the single scan.

Embodiment 1

The ink jet recording method of the present invention which uses such an ink jet recording apparatus 1 is described below using the case where a solid image having a 256-dot angle shown in FIG. 3 as an example. In the diagram, one frame enclosed by grids is one pixel and a black circle is print data.

Figure 4:
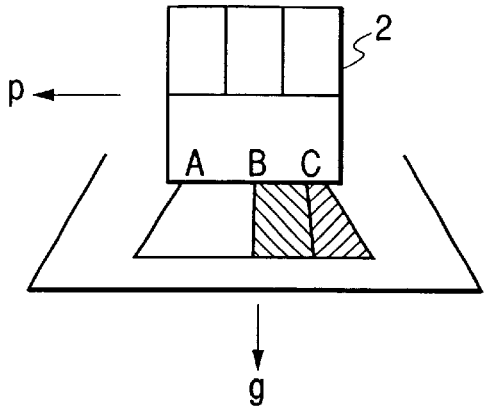
FIG. 4 is a diagram showing an arrangement of the discharge outlet array of a recording head.

The recording head unit 2 performs recording moving in the main scanning direction indicated by the arrow view p shown in FIG. 4. In this case, discharge is performed in the order of the discharge outlet array A, discharge outlet array B, and discharge outlet array C. In other words, when attention is paid to one element, black ink is first discharged from the discharge outlet array A and a treatment fluid is then discharged from the discharge outlet array B, and then black ink is discharged from the discharge outlet array C.

Thus, when the black ink is applied in double the amount under normal conditions, because the ink is insolubilized on a recording medium, permeation takes time and the fixing time is prolonged. Thus, in this example, by thinning the discharge from the discharge outlet array A and discharge outlet array C which discharge the black ink, the entire application amount is thinned and the fixing time is prevented from being prolonged.

FIGS. 5A to 5D show part of the print data recorded in each discharge outlet line. The actual print data shows a series of patterns visible in the drawing.

Figure 5A:
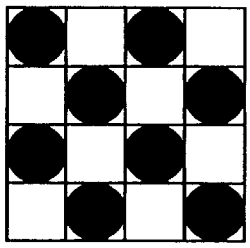
FIGS. 5A, 5B, 5C and 5D are diagrams showing one example of the print pattern according to the ink jet recording method of the present invention.
Figure 5B:
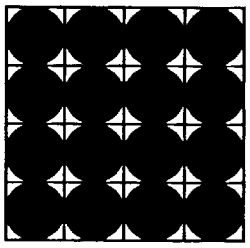
Figure 5C:
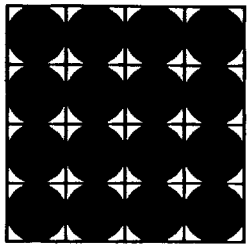
Figure 6:
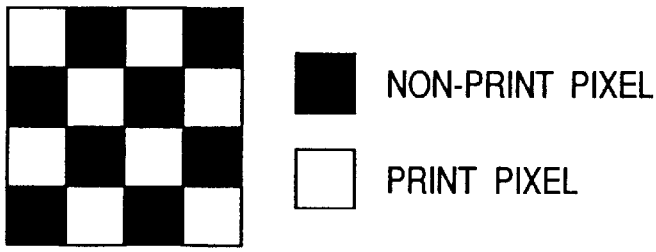
FIG. 6 is a diagram showing a print mask used in the ink, jet recording method of the present invention.

FIG. 5A shows part of the print data recorded in the discharge outlet line, FIG. 5B shows print port array B, and FIG. 5C shows part of the print data recorded in the discharge outlet array C. In other words, the print data of the discharge outlet array A is recorded while being thinned to 50%. The thinning of print data is performed using the print mask as shown in FIG. 6 so that uniform thinning can be performed. This reduces the amount of ink discharge from the discharge outlet array A to 50% of the amount of ink discharge from another discharge outlet line.

After printing is performed on plain paper in one pass according to the ink jet recording method, the plain paper is overlapped on the solid part, a load of about 100 g is applied, and the time no ink is transcribed on the overlapped plain paper is measured (hereinafter fixing time). Also, the optical density (OD) of a printed image is measured by storing the printed image under normal temperature and normal humidity for 24 hours using Macbeth's optical density measuring instrument RD914.

The results are listed in Table 1.

TABLE 1

| Execution example | Line-A application amount/Line-B application amount | Fixing time (seconds) | OD |
|---|---|---|---|
| 1 | 0.5 | 30 | 1.30 |
| 2 | 2.0 | 60 | 1.25 |
| Comparative Example 1 | 1.0 | 120 | 1.40 |
| Comparative Example 2 | 0.25 | 15 | 1.20 |
| Comparative Example 3 | 0.75 | 80 | 1.35 |

TABLE 1-continued

| Execution example | Line-A application amount/Line-B application amount | Fixing time (seconds) | OD |
|---|---|---|---|
| Comparative Example 4 | 1.3 | 100 | 1.34 |

Figure 7:
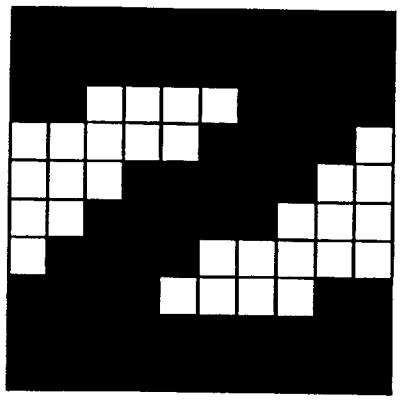
FIG. 7 is a diagram showing another example of the printer pattern according to the ink jet recording method of the present invention.
Figure 8:
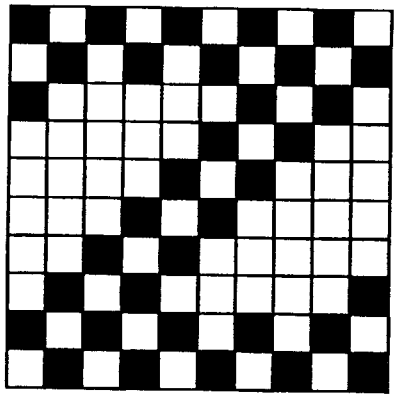
FIG. 8 is a diagram showing another example of the printer pattern according to the ink jet recording method of the present invention.

On the other hand, as shown in FIG. 7, the same examination as above is executed for characters. The black part is a print pixel. Hereupon, FIG. 8 shows the print data in which the print data of FIG. 7 is thinned to 50%. The print data of FIG. 8 is printed in the discharge outlet array A and the print data of FIG. 7 is printed in the discharge outlet array B and discharge array C. For the character quality, an image with a sharp edge is obtained.

Embodiment 2

Another example regarding the ink jet recording method using the same ink jet recording apparatus 1 as in Example 1 is described below.

Figure 3:
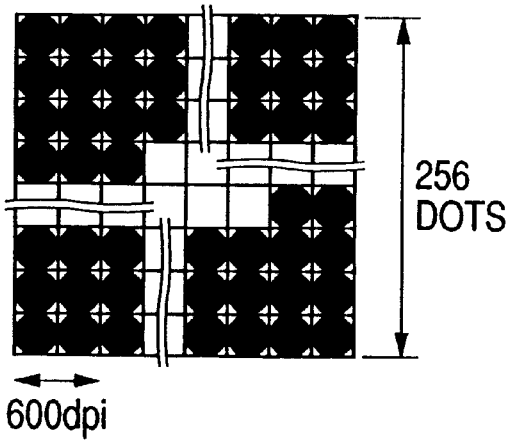
FIG. 3 is a diagram showing an example of print data.

In the same manner as in Example 1, the case where a solid image having a 256-dot angle shown in FIG. 3 is printed is described.

In Example 1, the print data of the discharge outlet array A is thinned, and here, the print data in the discharge outlet array C is printed by being thinned to 50%. In other words, FIG. 5A is handled as the print data recorded in the discharge outlet array C, FIG. 5B is handled as the print data recorded in the discharge outlet array B, and FIG. 5C is handled as the print data recorded in the discharge outlet array A. For the recording method, when the recording head unit 2 moves in the main scanning direction indicated by an arrow view 3, recording is performed in the order of the discharge outlet array A, discharge outlet array B, and discharge outlet array C. The fixing time and the OD measurement method are the same as in Example 1.

These measurement results are listed in aforementioned Table 1.

On the other hand, the same examination as in Example 1 is also executed for the character shown in FIG. 7. Here, FIG. 8 shows a pattern in which FIG. 7 is thinned to 50%. The print data of FIG. 8 is printed in the discharge port C and the print data of FIG. 7 is printed in the discharge outlet array B and discharge outlet array A.

For the character quality, an image with a sharp edge similar to Example 1 is obtained.

COMPARATIVE EXAMPLE 1

As Comparative Example 1, an example in which printing is performed by the conventional ink jet recording method is quoted. In other words, recording is performed by setting the application amount to the same amount without thinning all print data in the discharge outlet array A, discharge outlet array B, and discharge outlet array C. FIG. 5B of the print data used in Example 1 is handled as the print data of the discharge outlet array B and FIG. 5C is handled as the print data of the discharge outlet array A and discharge outlet array C. Then, the fixing time and OD are measured in the same as in Example 1.

These measurement results are listed in aforementioned Table 1.

Although a high-density result is obtained regarding the OD, the fixing time is exceedingly prolonged, and takes quadruple time of Example 1 and double time of Example 2.

On the other hand, also for the character shown in FIG. 7, the same examination as aforementioned execution example is made. The print data of FIG. 7 is printed in the discharge outlet array A, discharge outlet array B, and discharge outlet array C.

Hereupon, for the character quality, an image with the same sharp edge as in Examples 1 and 2 is obtained.

COMPARATIVE EXAMPLE 2

Figure 5D:
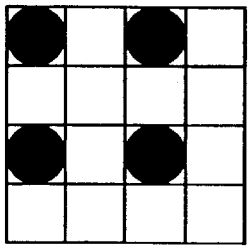

As Comparative Example 2, among the print data used in Example 1, the print data of the discharge outlet array A is printed so as to be thinned to a 25% duty ratio for the print data of the discharge outlet array B and discharge outlet array C, as shown in FIG. 5D.

Then, the fixing time and OD are measured in the same manner as in Example 1.

This measurement result is shown in aforementioned Table 1.

For the OD, a considerable density result is obtained. On the other hand, the fixing time is shortened to half the time of the execution example.

Figure 9:
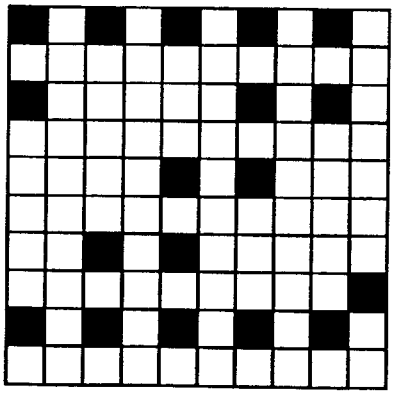
FIG. 9 is a diagram showing another example of the printer pattern according to the ink jet recording method of the present invention.

On the other hand, also for the character shown in FIG. 7, the same examination as in the aforementioned example is made. The print data of FIG. 9 is printed so as to be thinned to a 25% duty ratio for the print data of FIG. 7. The print data of FIG. 9 is printed in the discharge outlet array A and the print data of FIG. 7 is printed in the discharge outlet array B and discharge outlet array C.

Hereupon, for the character quality, although the sharpness of the edge is maintained as compared with Examples 1 and 2 and Comparative Example 1, the character is low in the density and inferior in its sharpness because it has no contrast.

COMPARATIVE EXAMPLE 3

As Comparative Example 3, the print data of the discharge outlet array A is printed so as to be thinned to a 75% duty ratio for the print data of the discharge outlet array B and discharge outlet array C (not shown). The fixing time and OD are measured in the same manner as in Example 1. As listed in Table 1, the fixing time is 80 (seconds) and the OD is 1.35.

COMPARATIVE EXAMPLE 4

As Comparative Example 4, the print data of the discharge outlet array C is printed so as to thinned to a 75% duty ratio for the print data of the discharge outlet A and discharge outlet array B (not shown). The fixing time and OD are measured in the same manner as in Example 1. As listed in Table 1, the fixing time is 100 (seconds) and the OD is 1.34.

In consideration of each result of Example 1, Example 2, Comparative Example 1, Comparative Example 2, Comparative Example 3, and Comparative Example 4, as compared with the conventional ink jet recording method, the fixing time is one fourth in Example 1 and half in Example 2, which can prevent the fixing time from being prolonged. Further, the OD is 1.30 in Example 1 and is 0.10 less than that of Comparative Example 1. Also, the OD is 1.25 in Example 2 and is 0.15 less than that of Comparative Example 1. However, the OD of 1.30 and the OD of 1.25 are within the allowable range, and it cannot be said that the formed image quality deteriorates greatly. Besides, for an ink jet recording apparatus which uses the conventional permeation type ink, a value before and after OD=1.30 is normal. Moreover, because an OD value before and after 1.2 is normal in the simplified recording mode called draft mode, 1.2 may be regarded as the lower limit for the OD value if the OD is sufficiently higher than that for the draft mode.

Each of the aforementioned execution examples is obtained, and the same effect is also realized for the color inks of cyan, magenta, and yellow.

Further, in the multi-pass print of two passes or more as well as one pass, the effect is confirmed. The two-pass print is described here.

Figure 10:
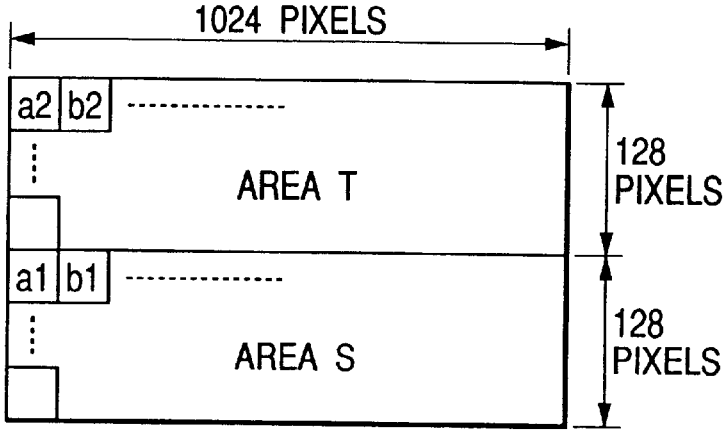
FIG. 10 is a diagram showing the print mask used for two-pass print.

FIG. 10 shows a print mask used for the two-pass printing. The print mask consisting of 256 vertical pixels and 1,024 horizontal pixels is divided into two areas, area S and area T, each having 128 vertical pixels. The print mask data alternatively arranges 0 and 1 for each pixel. Further, the entire print mask is created so that a complementary relationship may be established and the area T becomes an inverse pattern of the area S. Therefore, a1 and a2 and b1 and b2 are mutually established in the complementary relationship. In other words, both the areas S and T form random patterns in which 0 or 1 occupies 50% of the data. Random patterns are used in the print mask so that the duty ratio at which image data is printed in the discharge outlet array A, discharge outlet array B, and discharge outlet array C, based on always one-time scan by thinning the image data on an average, respectively is made equal for one-pass printing.

Next, the printing method is described with reference to FIGS. 11 to 13. One head is described here. For another head, printing is performed in the same manner using the same print mask. The print object is black data.

Figure 11:
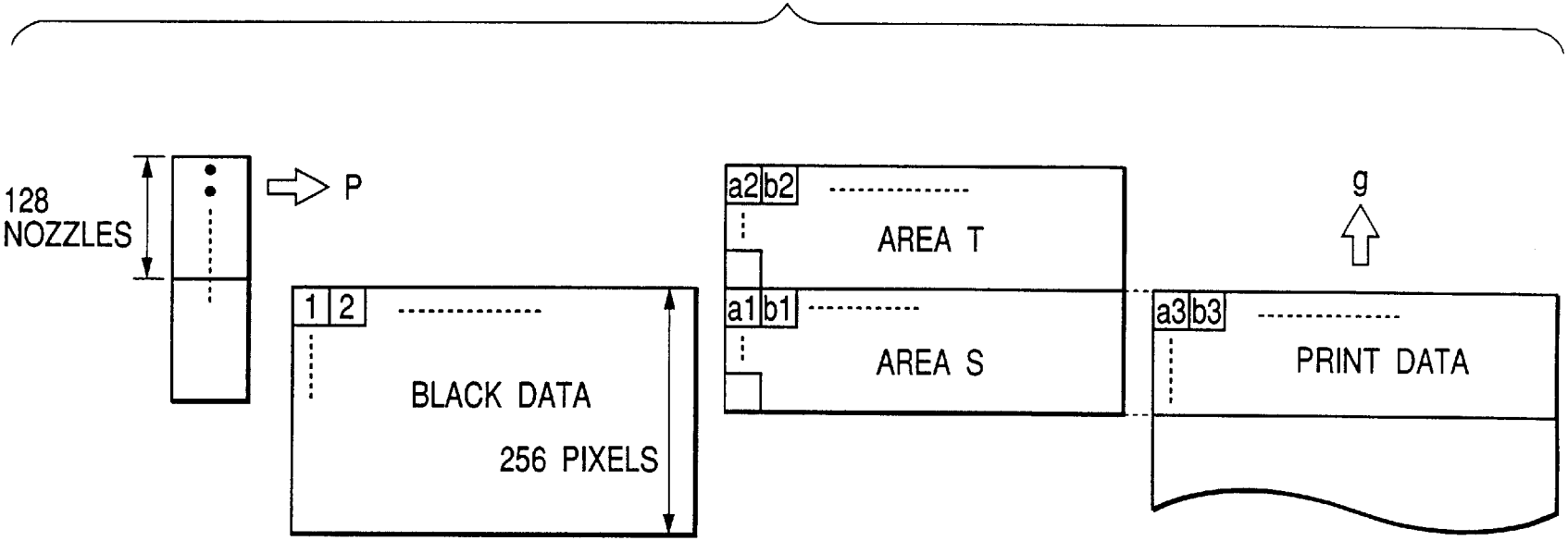
FIG. 11 is a diagram showing a flow of the first scanning print for two-pass print.
Figure 12:
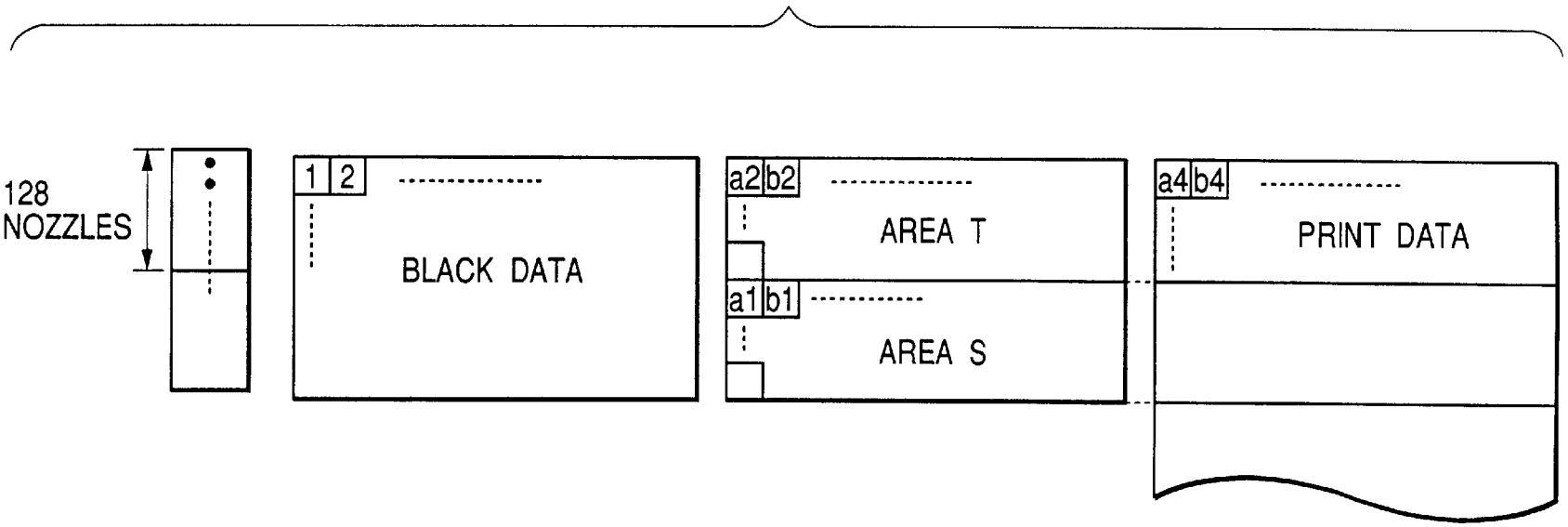
FIG. 12 is a diagram showing a flow of the second scanning print for two-pass print.

As shown in FIG. 11, 128 nozzles at the lower half in the sub scanning direction of a print head, where the direction of the arrow view p is the main scanning direction and the direction of the arrow view q is the sub scanning direction, perform printing on a recording medium in the first scan. At this time, data to be printed (hereinafter referred to as print data) is the AND data between the black data and print mask data in the area S. For example, the AND data between the pixel 1 of the black data and the pixel a1 of the print mask data becomes the pixel a3 of the print data and the AND data between the pixel 2 of the black data and the pixel b1 of the print mask data becomes the pixel b3 of the print data. After printing is performed to the end of the recording medium, the recording medium is moved only by half (h/2) the width h of the head.

In the second scanning, printing is performed on the recording medium using the entire head. At this time, as shown in FIG. 12, the upper half in the sub scanning direction of the head prints the AND data between the black data and the area T of the print mask data. For example, the AND data between the pixel 1 of the black data and the pixel a2 of the print mask data is printed and becomes the pixel a4 of the print data. The lower half in the sub scanning direction of the head prints the AND data between the black data and the area S of the print mask data. For example, the AND data between the pixel 128 of the black data and the pixel a1 of the print mask data is printed. After printing is performed to the end of the recording medium, the recording medium is moved only by half (h/2) the width h of the head.

Figure 13:
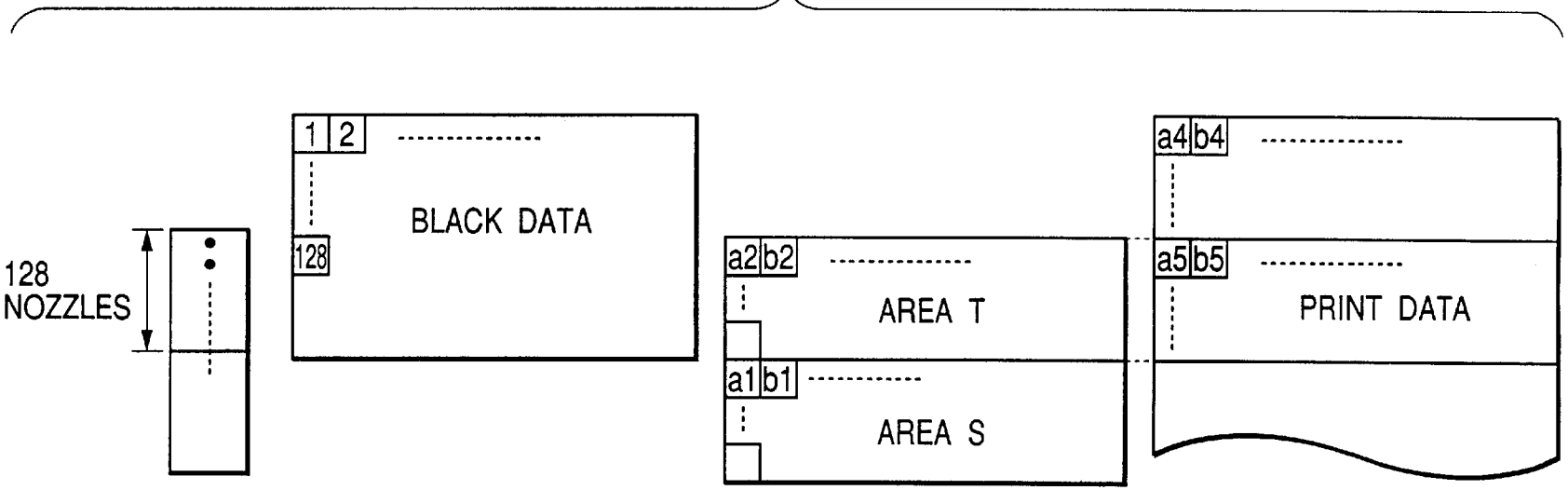
FIG. 13 is a diagram showing a flow of the third scanning print for two-pass print.

In the third scanning, as shown in FIG. 13, the upper half in the sub scanning direction of the head prints the AND data between the black data and the area T of the print mask data. For example, the AND data between the pixel 128 of the black data and the pixel a2 of the print mask data is printed and becomes the pixel a5 of the print data. Thus, by aforementioned two-times scan, the black data is pinted on the recording medium. Though the black data is AND processed with the print mask data of both the areas S and T in this two-times scan, the same effect as in one-pass print is anticipated because both the areas S and T are established in a complementary relationship.

Embodiment 3

In Example 1 and Example 2, the entire application amount is thinned by thinning print data according to a fixed thinning pattern. The same effect is obtained by operating the discharge amount of ink without thinning the print data even if the entire application amount is reduced.

In the ink jet recording method of the present invention, an example in which the discharge amount from the discharge outlet is reduced is described below.

In the same manner as in Example 1 and Example 2, the case in which a solid image at a 256-dot angle shown in FIG. 3 is printed is described as an example. Each print data of the discharge outlet array A, discharge outlet array B, and discharge outlet array C all uses the pattern of FIG. 5B. Also, characters are all printed using the pattern of FIG. 7 of the discharge outlet array A, discharge outlet array B, and discharge outlet array C in the same manner. Then, the discharge amount from the discharge outlet is operated as follows.

For example, when the discharge amount of the discharge outlet array A is 9 ng and the discharge amount of the discharge outlet array B and discharge outlet array C is 18 ng, that is to say, the application amount from the discharge outlet array A is the same as in Example 1, the same results as in Example 1 are obtained.

Then, when the discharge amount of the discharge outlet array A and discharge outlet array B is 18 ng and the discharge amount of the discharge outlet array C is 9 ng, that is to say, the application amount from the discharge outlet array C is the same as in Example 2, the same results as in Example 2 are obtained.

Further, when the discharge amount of the discharge outlet array A is 6 ng and the discharge amount of the discharge outlet array B and discharge outlet array C is 18 ng, that is to say, the application amount from the discharge outlet array A is the same as in Comparative Example 2, the same results as in Comparative Example 2 are obtained.

Also for the examination (OD/fixing time) based on control of the aforementioned discharge amount, the same results as in Table 1 are obtained.

Also for the character quality, the same results as in Examples 1 and 2 and Comparative Example 2 are obtained.

Thus, in the ink jet recording method of the present invention, a means for reducing the application amount of ink to a recording medium may reduce print data and operate the discharge amount of the discharge outlet.

In the aforementioned execution examples, the following inks are used.

| (Treatment fluid) | |
|---|---|
| glycerin: | 7.0% |
| diethyleneglycol: | 5.0% |
| PAA-1L-15B | 24.0% |
| (15% aqueous solution of polyallylamine): | |
| 50% acetic acid aqueous solution: | 7.0% |

-continued

| | |
|---|---|
| cation G50 (51% aqueous solution of benzalkonium chloride): | 1.92% |
| butyltriglycol: | 0.95% |
| Pure water: | 54.11% |
| (Black ink) | |
| glycerin: | 7.5% |
| thiodiglycol: | 7.5% |
| urea: | 7.5% |
| IJA 260 (10% aqueous solution): | 9.50% |
| Projet Fast Black 2 (4% aqueous solution): | 36.5% |
| Daiwa Yellow 330EP: | 0.27% |
| Direct Blue 199 (10% aqueous solution): | 7.20% |
| ammononium sulfate: | 0.45% |
| isopropyl alcohol: | 4.00% |
| Pure water: | 19.22% |
| NaOH: | 0.36% |
| (Cyan ink) | |
| glycerin: | 7.5% |
| thiodiglycol: | 7.5% |
| urea: | 7.5% |
| Project Fast Cyan 1C (10% aqueous solution): | 28% |
| Acetylenol EH (Product name manufactured by Kawaken Fine Chemical Co., Ltd. and its chemical substance name is ethylene oxide-2,4,7,9-tetramethyl-5-decyne-4,7-diol) | |
| Pure water: | 44.4% |
| 50% IPA (isopropyl alcohol) aqueous solution: | 5% |
| (magenta ink) | |
| glycerin: | 7.5% |
| thiodiglycol: | 7.5% |
| urea: | 7.5% |
| Proget Fast Magenta 2C (5% aqueous solution): | 45% |
| ammonium sulfate: | 0.27% |
| Acetylenol EH: | 0.1% |
| 10%-LiOAc (10% aqueous solution): | 1.84% |
| trietanolamine: | 0.84% |
| Pure water: | 24.43% |
| 50% IPA aqueous solution: | |
| (Yellow ink) | |
| glycerin: | 7.5% |
| thiodiglycol: | 7.5% |
| urea: | 7.5% |
| Projet Fast Yellow 2 (4.3% aqueous solution): | 52.33% |
| Daiwa Yellow 330GR: | 0.65% |
| ammonium sulfate: | 0.25% |
| Acetylenol EH: | 0.1% |
| 4N-LiOH: | 1.88% |
| triethanolamine: | 0.74% |
| Pure water: | 16.55% |
| 50% IPA aqueous solution: | 5% |

As described above, when the ink jet recording method of the present invention is used, a high-density image with sharpness and a sharp edge can be formed and the fixing time can be shortened as compared with the conventional ink jet recording method and higher speed recording is enabled.

II. The invention to attain the second object described above is described. The present invention can be configured by combining the invention described according to Embodiment 4, 5 or 6 for the invention described according to aforementioned embodiment 1, 2 or 3.

First, an example of the basic configuration of an ink jet recording apparatus to which the present invention can be applied is described with reference to FIGS. 23 to 25.

Figure 23:
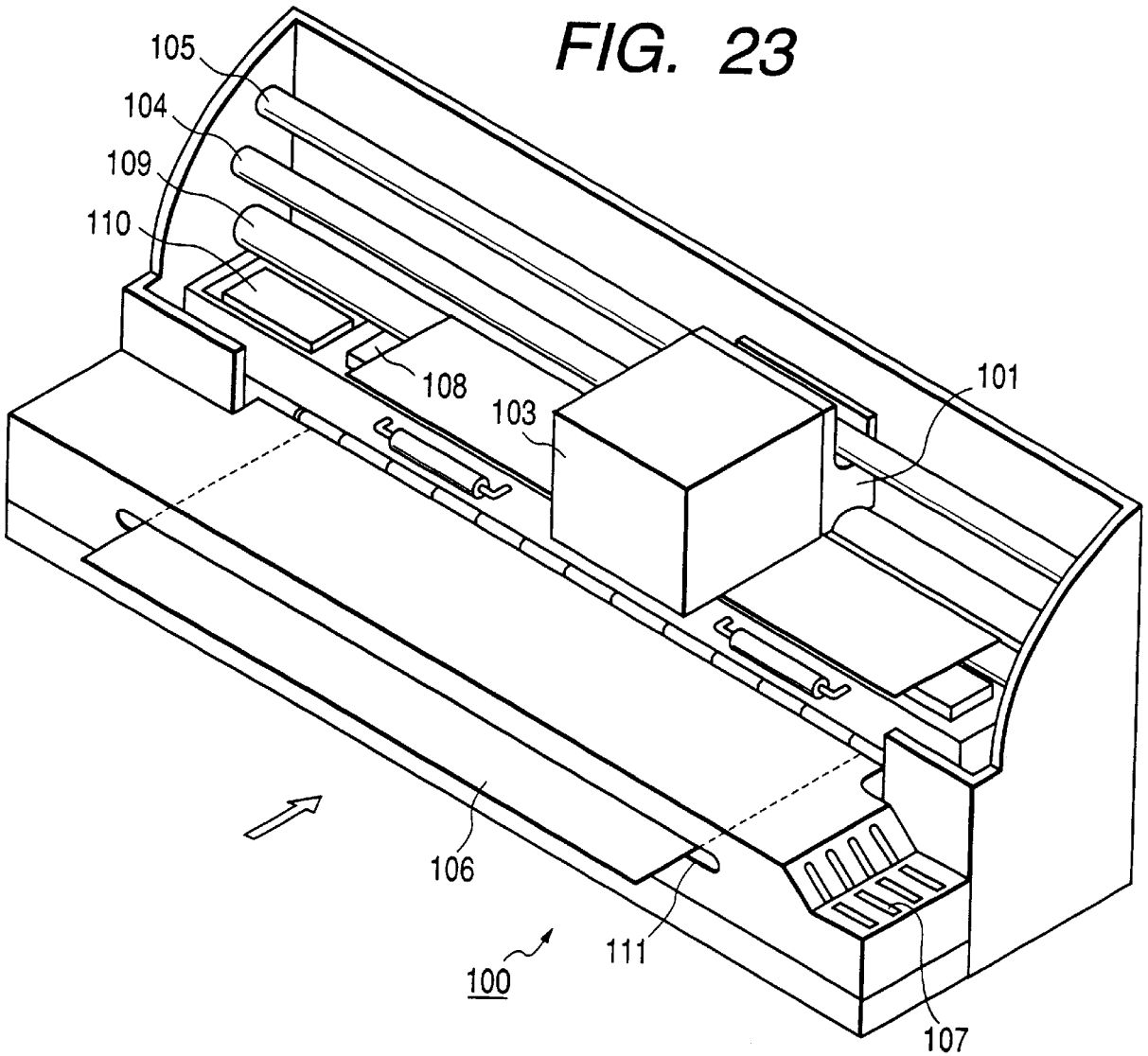
FIG. 23 is a schematic perspective diagram showing the configuration example of an ink jet recording apparatus to which the present invention can be applied.

In FIG. 23, a recording medium 106 inserted in the paper feed position of a recording apparatus 100 is transported in the sub scanning direction toward the recordable area of a recording head unit 103 by a feed roller 109. A platen 108 is installed at the lower part of the recording medium in the recordable area. A carriage 101 has a configuration in which it can move to the direction fixed by two guide shafts 104 and 105 and reciprocally scans the recording area in the main scanning direction. The carriage 101 accommodates a recording head unit 103 including a head unit for ink which discharges a plurality of color inks, a recording head equipped with a head unit for a treatment fluid which discharges the treatment fluid, and an ink tank which supplies the ink and treatment fluid to each recording head. A plurality of color inks provided in the ink jet recording apparatus of this example include black (Bk), cyan (C), magenta (M) and yellow (Y).

A recovery unit 110 is installed at the lower left of an area to which the carriage 101 can move and caps the discharge outlet unit of the recording head during non-recording. The left end of the area to which the carriage 101 can move is called "home position" of the recording head. 107 is a switch unit and a display element unit, and the switch unit is used for the power ON/OFF of the recording apparatus and setting of various recording modes and the display element unit displays the state of the recording apparatus.

Figure 24:
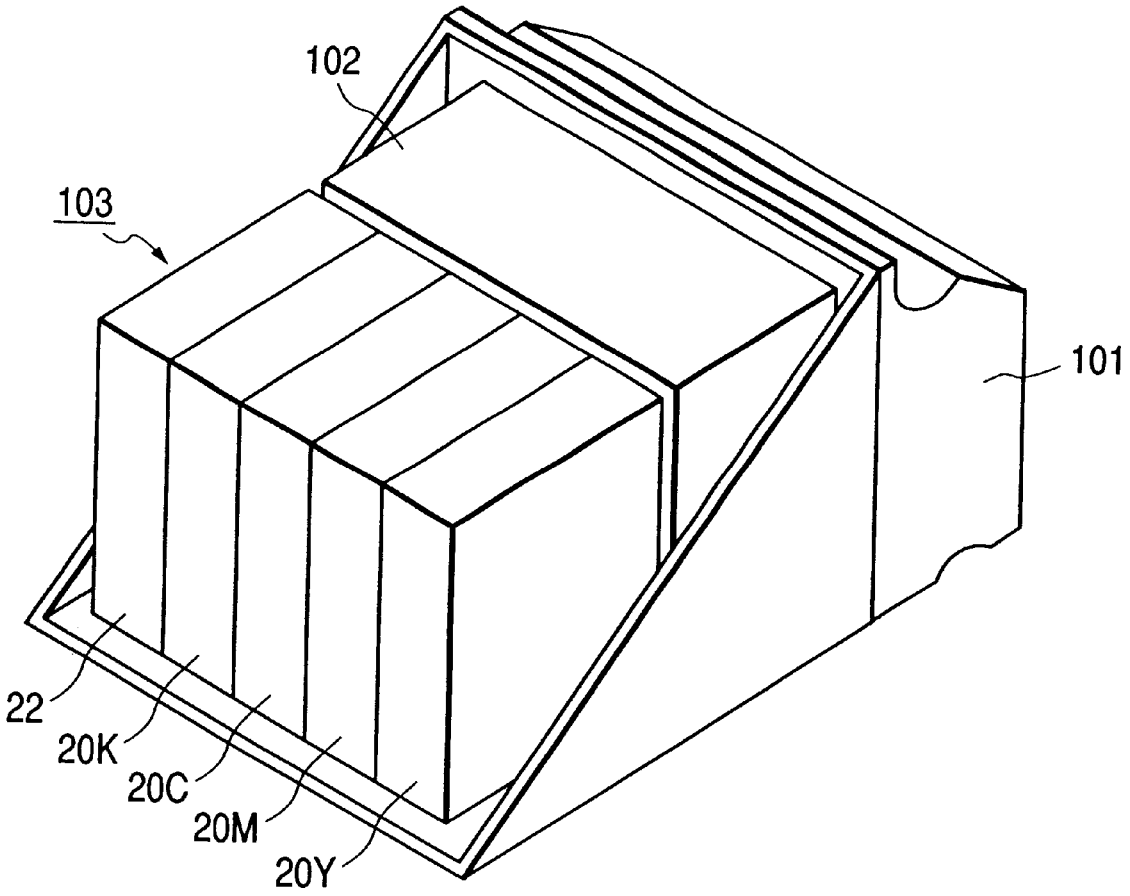
FIG. 24 is a schematic perspective diagram showing the configuration example of the ink jet recording head in FIG. 23.

FIG. 24 is a perspective diagram of the recording head unit 103. This example has a configuration in which each color ink of black, cyan, magenta, and yellow and the tank of the treatment fluid can all be replaced independently. The carriage 101 installs a recording head 102 which discharges Bk, C, M and Y, and the treatment fluid, tank 20k for Bk, tank 20C for C, tank 20M for M, tank 20Y for Y and a tank 22 of the treatment fluid. Each tank 20K, 20C, 20M, 20Y and 21 is connected to the recording head 102 via the connection unit with the recording head 102 and supplies the ink and treatment fluid to the discharge outlet of the recording head 102.

Figure 20A:
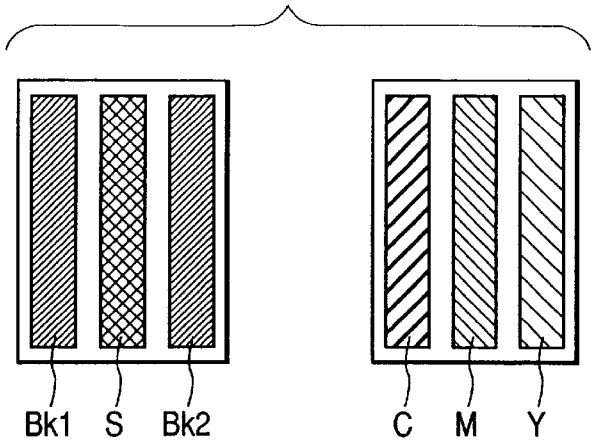
FIGS. 20A, 20B and 20C are configuration diagrams of different recording heads according to the embodiment of the present invention.
Figure 20B:
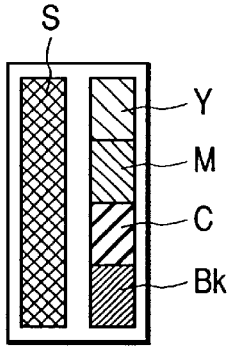

As another configuration of the recording head 102, for example, as shown in FIG. 20A later, the tank of a treatment fluid S and the tank of Bk may have an integrated configuration and by using the tanks of C, M and Y as an integrated structure, the head unit for the treatment fluid which discharges the treatment fluid S may be formed as a sandwich structure consisting of two head units for discharging Bk or as shown in FIG. 20B, by using the tanks of C, M and Y as an integrated configuration, their heads may be formed into a vertical head configuration.

Figure 25:
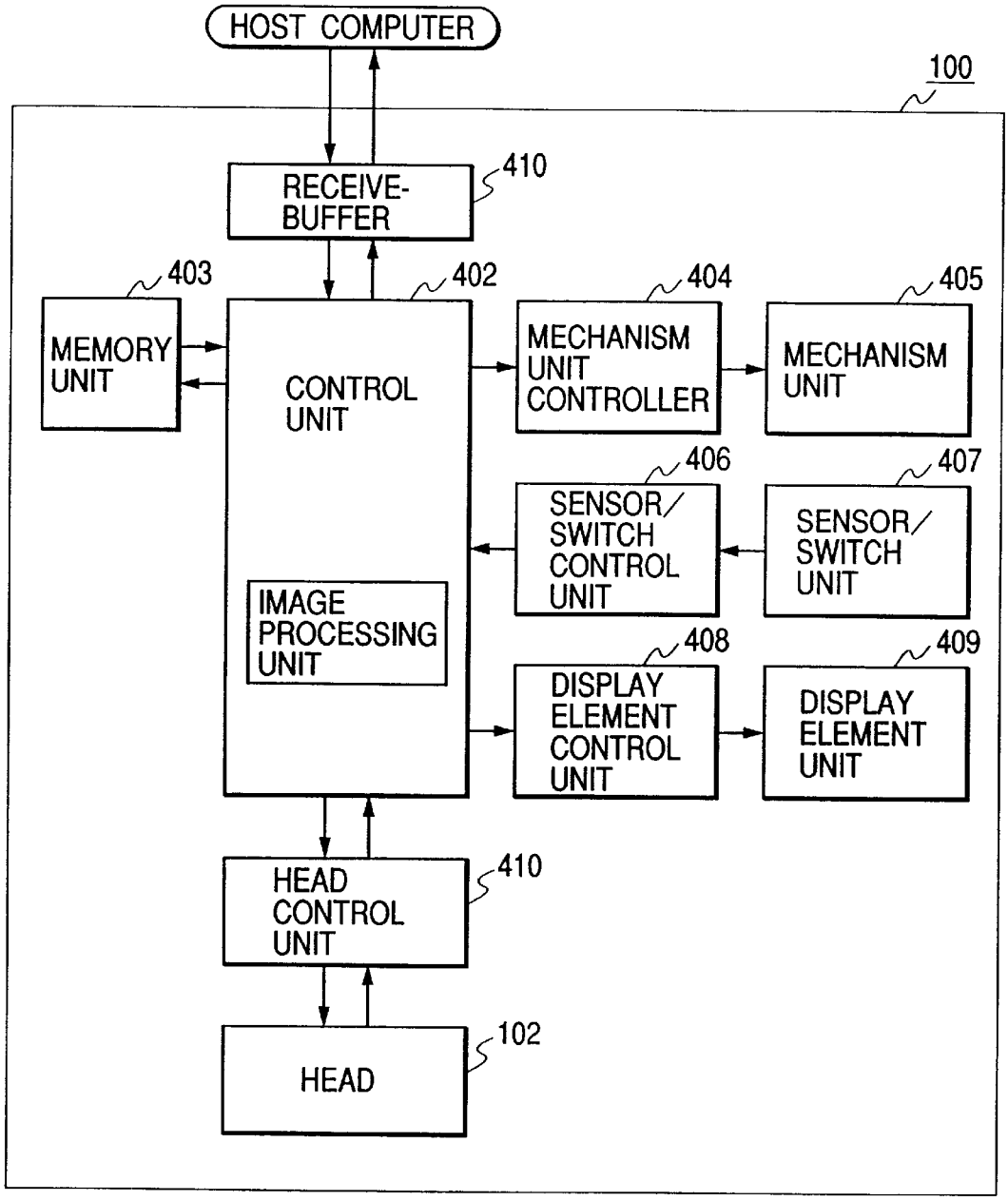
FIG. 25 is a block configuration diagram of the control system in the ink jet recording apparatus of FIG. 23.

FIG. 25 is a block diagram of the control system in the ink jet recording apparatus to which the present invention can be applied. Characters to be recorded and data of an image (hereinafter referred to as "image data") are input from a host computer to a receive buffer 401 of the recording apparatus 100. Then, the data which checks that correct data is transferred and the data which reports the operating state of the recording apparatus 100 are returned from the recording apparatus 100 to the host computer. The data of the receive-buffer 401, under the control of a CPU 402, is transferred to a memory unit 403 and is primarily stored in its RAM (random access memory). A mechanism unit controller 404 drives a mechanism unit 405 such as a carriage motor and an array feed motor by a command from the CPU 402. A sensor/switch control unit 406 sends a signal from a sensor/switching unit 407 consisting of various sensors and SW (switches) to the CPU 402. A display element control unit 408 controls a display element unit 409 consisting of a group of display panels LEDs and liquid crystal display elements by a command from the CPU 402. A recording head control unit 410 controls the recording head 102 by a command from the CPU 402, detects the temperature information indicating the state of the recording head 102, and transfers it to the CPU 402.

Embodiment 4

Figure 14:
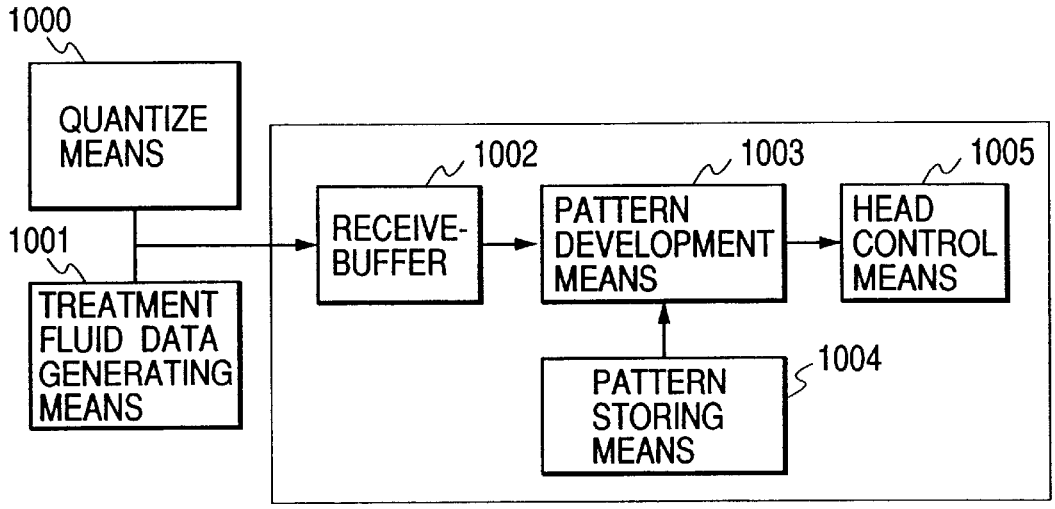
FIG. 14 is a block configuration diagram of the principal part for describing the fourth embodiment of the present invention.

FIG. 14 is a block diagram for describing the principal part according to Embodiment 4 of the present invention.

In FIG. 14, 1000 is a quantizing means which quantizes input data and generates the quantized data of each color ink and 1001 is a data generating means which generates the treatment fluid quantized data from each ink quantized data. 1002 is a receive-buffer which receives the quantized data for respective color inks and treatment fluids and 1004 is a pattern storing means that stores a matrix pattern. 1003 is a pattern developing means as a data allocating means which refers to the matrix pattern stored in the pattern storing means 1004 and develops the input quantized data in a bit map manner. 1005 is a head control means which drives the recording head 102 according to thus developed data. The head control means functions as first and second control means that control the head unit for discharging ink and the head unit for the treatment fluid in the recording head described later. Normally, the quantizing means 1000 is installed in the host computer.

This example describes below the case where, in the quantizing means 1000, the quantized data of each color ink is quinarized at a resolution of 300 by 300 dpi, and in the inside of the recording apparatus 100 its quantized data is developed into the data at a resolution of 600 by 600 dpi using a 2 by 2 dot matrix and recorded.

Figure 15:
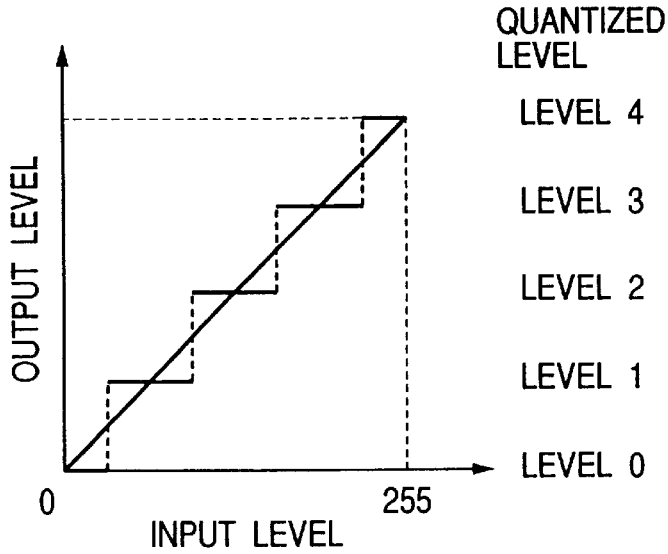
FIG. 15 is an explanatory diagram of quantization according to the fourth embodiment of the present invention.
Figure 16:
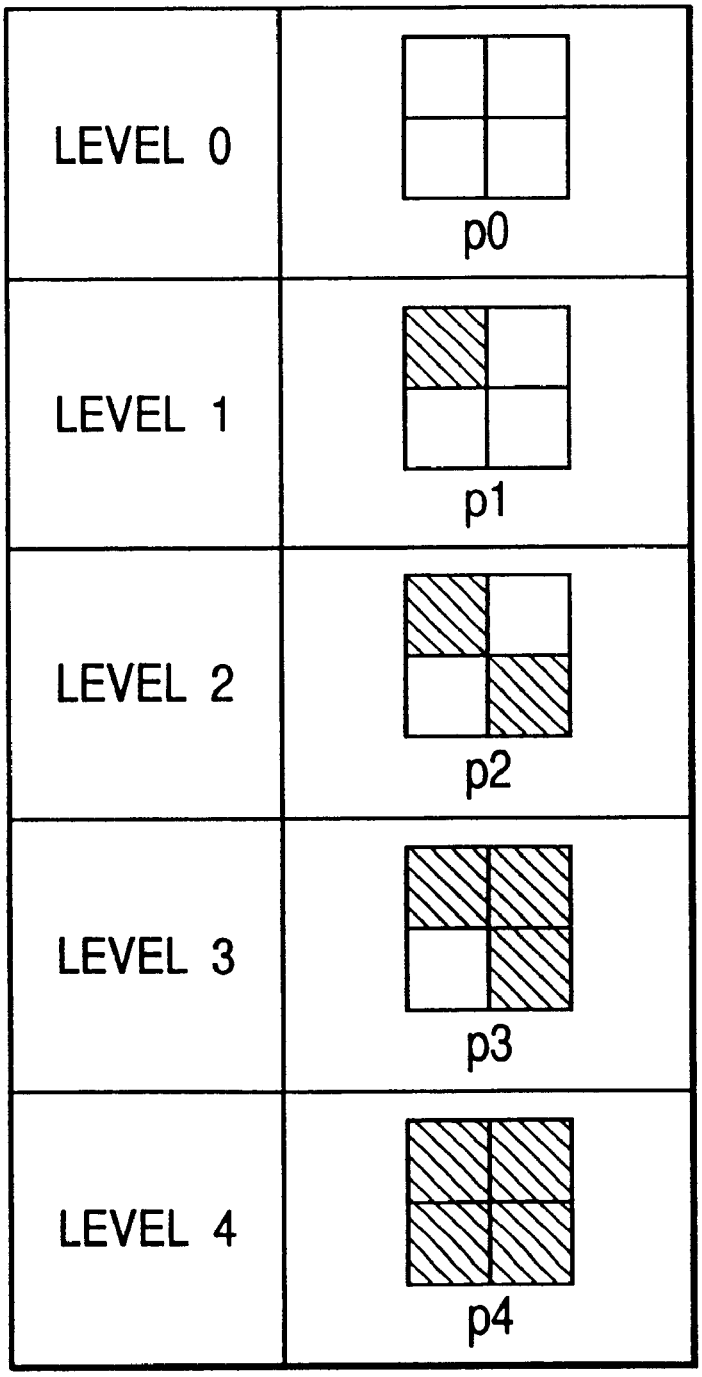
FIG. 16 is an explanatory diagram of the matrix pattern according to the fourth embodiment of the present invention.

FIG. 15 is an explanatory diagram in which the quinarization method is conceptually shown, each pixel is quantized into levels 0 to 4 due to a predetermined threshold according to the input level. FIG. 16 shows a matrix pattern which corresponds to each output level. Because a 2 by 2 matrix is used, a quinary representation is enabled according to the number of stored pixels in the matrix.

FIG. 20A shows the configuration of the recording head of the recording apparatus of Embodiment 4.

The recording head of FIG. 20A has a configuration in which two left and right heads are arranged in the scanning direction of the carriage 101 in the same diagram, and wherein the one head on the left arranges a group of nozzles for discharging a treatment fluid (S) between nozzle groups for discharging two black inks (Bk1 and Bk2) and the other head on the right arranges a group of nozzles which discharges each color ink of yellow (Y), magenta (M), and cyan (C). A group of nozzles for discharging the Y, M, and C, and Bk inks comprises an array of discharge outlets from which the inks can be discharged and a head unit for discharging the ink. Similarly, a group of nozzles for discharging the treatment fluid comprises an array of a discharge outlet from which the treatment fluid can be discharged and a head unit for discharging the treatment fluid. In the recording apparatus 106, by sandwiching the treatment fluid dot by a black ink dot, high-quality Bk (black) text with high density and the Bk (black) graphics can be recorded.

Figure 17:
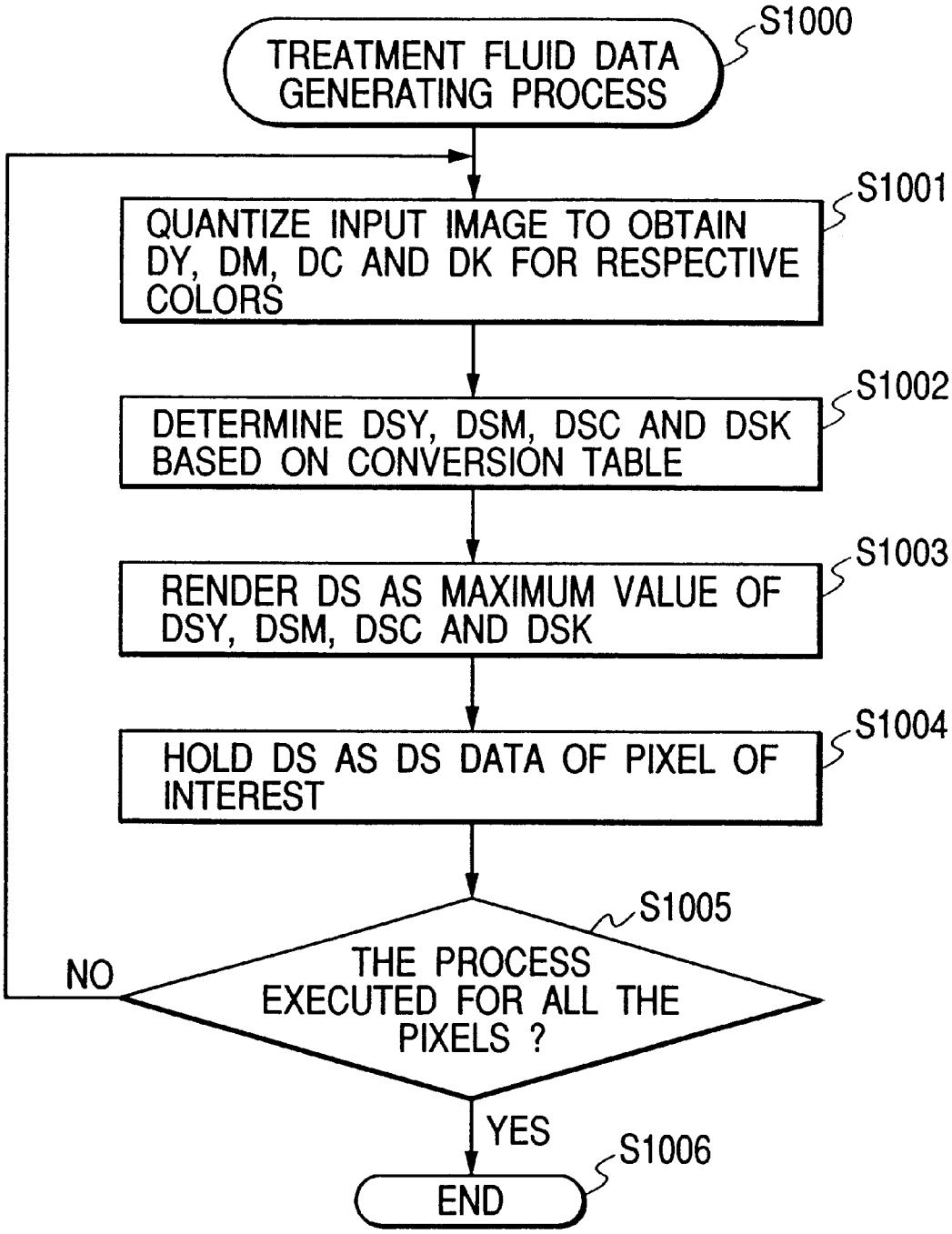
FIG. 17 is a flowchart for describing the data processing according to the fourth embodiment of the present invention.

FIG. 17 is a flowchart for describing the data generating processing for the treatment fluid by the means 1001 of FIG. 14.

First, the quantize means 1000 quantizes one pixel of an input image to be processed into the quantitize data (DY, DM, DC and DK) for each color ink (Y, M, C and Bk) (S1001). The quantized level is quinary levels 0 to 4 as described previously. For the head configuration in this example of FIG. 20A, because a group of nozzles for discharging two Bk inks (Bk 1 and Bk 2) is configured, in each level of FIG. 16, two dots of Bk 1 and Bk 2 are formed in the same position on the recording medium 106. Where, for example, assume DY =level 0, DM=level 3, DC=level 2, and DK=level 0.

Then, with reference to the corresponding tables (FIGS. 18A to 18D) between the quantized data (DY, DM. DC and DK) for each color ink and the corresponding treatment data (DSY, DSM, DSC and DSK) of each color, the DSY, DSM, DSC and DSK are determined (S1002). Then, the treatment fluid data (DSY, DSM, DSC and DSK) corresponding to the maximum value in the DY, DM, DC and DK is assumed to be DS (S1003). In this assumed example, DS=DSM=level 2. Also, by directly comparing DSY, DSM, DSC and DSK, their maximum value may be assumed to be DS.

FIG. 19 is an explanatory diagram of how the dot of the treatment liquid is formed according the DSY, DSM, DSC and DSK of each level, and wherein the right side in the same diagram shows the case where the DS is determined depending on the DSY, DSM or DSC and the left side shows the case where the DS is determined by the DSK.

For the DS=DSK, as shown in the left side of FIG. 19, a treatment fluid dot is formed at a ratio of 2 to 1 for the number of ink dots (Bk 1+Bk 2=2 dots) in all levels regarding the black dot of the Bk ink. Then, when color data exists in this matrix and the color dots of the Y, M and C inks are formed, there is no real image problem from the viewpoint of water resistance, though a slightly greater amount of treatment liquid is applied on their dots.

On the other hand, for the DS=DSY, DSM or DSC as shown in the right side of FIG. 19, a treatment fluid dot is formed in the same pixel at a ratio of 1 to 1 for the number of ink dots in levels 1 and 2 regarding the color dots of the Y, M and C inks. Also, in level 3, two treatment dots are formed for the color three dots and are formed at a ratio of 3 to 2. Further, in level 4, two treatment fluid dots are formed for the four color dots and their ratio is 4 to 2.

Further, for such DS=DSY, DSM or DSC, that is, when a color dot is recorded, it is recorded in two cases: in one color and in two concurrent colors. For the single color, the treatment fluid is applied at the aforementioned ratio and for a secondary color, the treatment fluid is applied at half the ratio. In general, because of the dyes, density of the color ink is lower than the Bk ink, however sufficient water resistance is obtained even though the application amount of the treatment fluid is small. For example, although both DY and DC are in level 4, and the ratio of the number of color ink dots to the number of treatment fluid dots is 8 to 2, the water resistance is obtained without causing any problem in practical use.

Furthermore, because DY, DM and DC are hardly set to level 4, there is no substantial problem. It goes without saying that the treatment fluid table of each color that corresponds to DY, DM, DC and DK according to the dyes density and the types of dyes is changed, for example, when DY, DM and DC are in level 4, DSY, DSM and DSC can be set to level 3.

Such S1001 to S1004 processes are executed on all pixels and the treatment fluid data generating process terminates (S1005 and S1006).

Based on such generated treatment fluid data, by applying the treatment fluid during image recording, necessary sufficient treatment fluid can be applied even at any recording duty ratio. As a result, the cockling due to excessive application of the treatment fluid and uneven irregularity and deterioration of fixing due to ink overflow (beading) can be prevented or sufficient water resistance can be obtained because sufficient treatment fluid dots are applied even in a low duty area.

Embodiment 5

FIG. 20B is a configuration diagram of the recording head applied to the fifth embodiment of the present invention.

The recording head of this example has a configuration in which the right and left nozzle arrays of FIG. 20B are arranged so as to be aligned in the scanning direction of the carriage 101. The right-side nozzle array is an array of nozzles which discharge inks of Y, M, C and Bk. The left-side nozzle array is an array of the nozzles which discharge the treatment fluid S so as to correspond to the nozzles of respective color inks. The recording head of this example is a multi-color integrated type recording head which can discharge one color ink to a plurality of color inks.

Such a so-called vertical recording head configured in this manner enables more compactness of the entire unit than the case where the so-called horizontal type recording head shown in FIG. 20A is used. Also, during both the forward scan and backward scan of the recording head, because the recording sequence of each color ink during the forward scan and backward scan does not change even when the so-called bidirectional recording is performed, there is an advantage that there is no problem of generating a color uniformity every scanning period.

When a recording head having such configuration is used, the discharge data for the treatment fluid nozzle that corresponds to each color ink needs to be generated independently.

This embodiment describes, in the same manner as in the first embodiment described previously, the case where the quantizing means 1000 of FIG. 14 generates the quantized data quinarized at a resolution of 300 by 300 dpi and in the inside of the recording apparatus 100 the quantized data is developed into the data at a resolution of 600 by 600 dpi using a 2 by 2 dot matrix and recorded.

Figure 21:
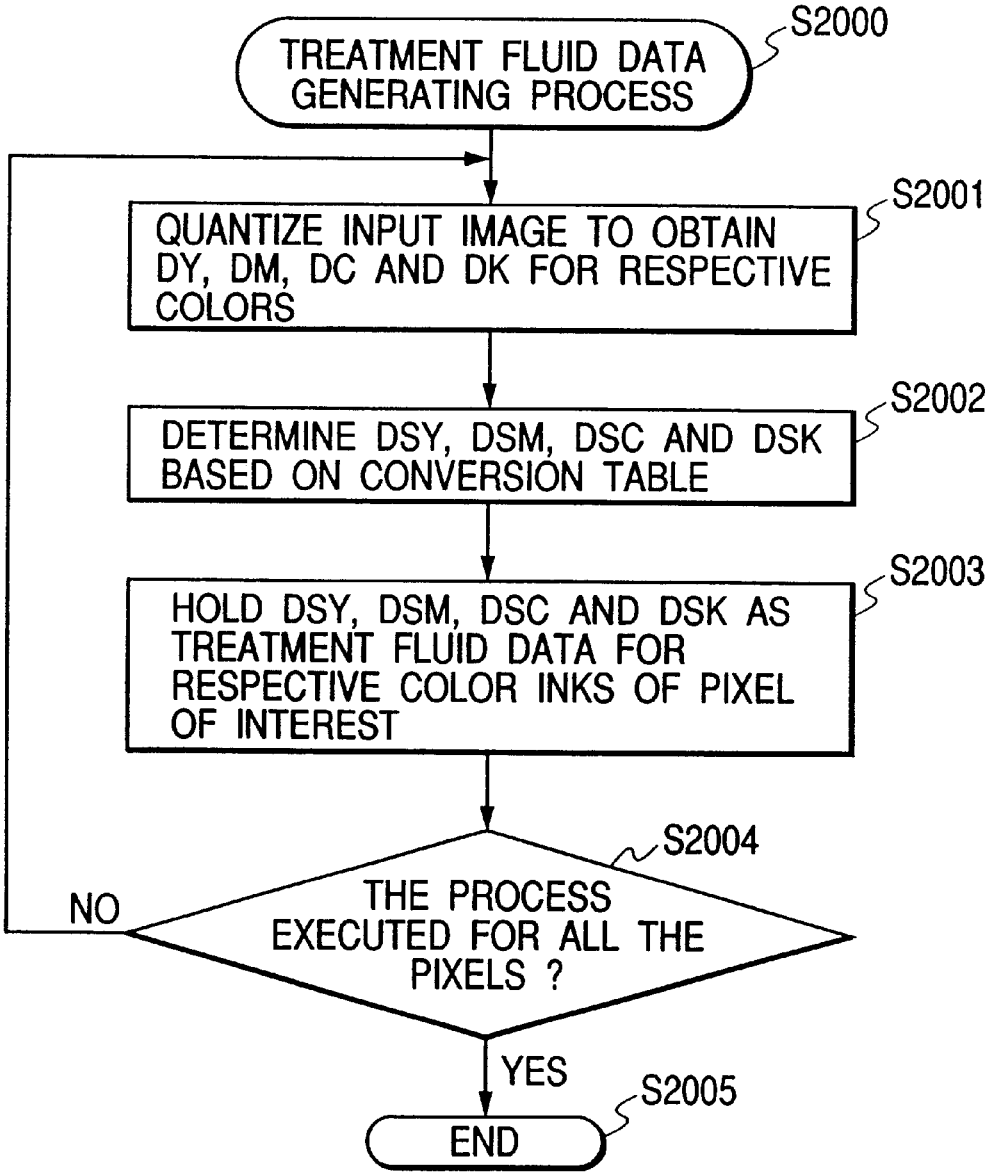
FIG. 21 is a flow chart for describing the data processing according to the fifth embodiment of the present invention.

FIG. 21 is a flowchart for describing the treatment fluid data generating process according to Embodiment 5 of the present invention.

First, the quantizing means 1000 quantizes the single element of an input image to be processed into the quantized data (DY, DM, DC and DK) for each color inks (Y, M, C and Bk) (S2001). The quantized level is quinary levels 0 to 4 described previously. Where, for example, assume DY=level 0, DM=level 3, DC level 2 and DK=level 0. Then, based on the quantized data (DY, DM, DC and DK) of each color, the quantized data (DSY, DSM, DSC and DSK) for the treatment fluid that corresponds to each color ink is generated with reference to the table shown in FIGS. 18A to 18D (S2002). In this assumed example, DSY=level 0, DSM=level 2, DSC=level 2 and DSK=level 0.

The quantized data DY, DM, DC and DK of each color ink and the quantized data DSY, DSM, DSC, and DSK for the treatment fluid are developed into the matrix pattern shown in FIG. 16 and are formed as color dots and treatment fluid dots according to a group of nozzles of the corresponding recording head. When the recording of FIG. 20B of this example is used, because the treatment fluid data is generated every data of one color, a slightly great amount of treatment fluid is applied to the recording area with a secondary color. However, as shown in FIG. 20B, because the nozzle with each color ink is vertically arranged, an offset exceeding one scan occurs in the actual secondary color recording, that is, a time lag exceeding the one scan of the recording head and a fault such as ink overflow does not occur. Also, by optimizing the application amount of treatment fluid corresponding to each color ink, a failure caused by the excessive application of treatment fluid can be prevented.

Thus, this present invention can also be applied to a recording head as shown in FIG. 20B in which a group of nozzles of each color ink is vertically configured, a high-quality image with good density uniformity can be formed even when bidirectional recording is performed and sufficient water resistance can also be obtained at any recording duty ratio.

Embodiment 6

Figure 20C:
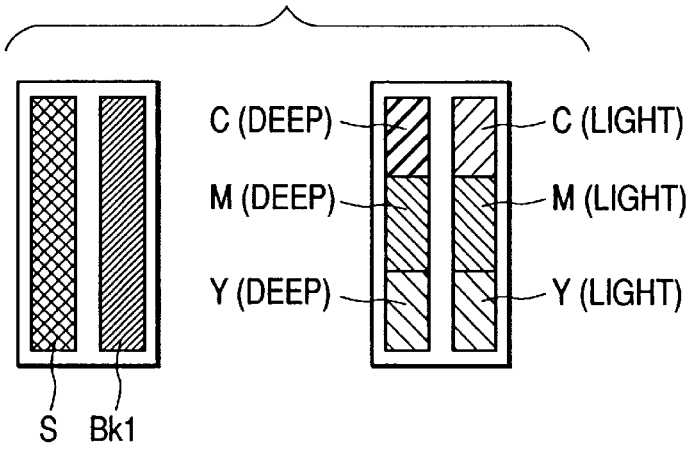

FIG. 20C is a configuration diagram of the recording head applied to Embodiment 6 of the present invention.

For this example, the two left and right recording heads of FIG. 20C aligned in the scanning direction of the carriage 101 comprise two chips, respectively. The recording head on the left in the same diagram is configured by combining the chip on which a group of nozzles which discharges the treatment fluid S and the chip on which a group of nozzles which discharges the Bk ink is formed. On the other hand, the recording head on the right in the same diagram is configured by combining the chip on which a group of nozzles which discharges the deep ink of C, M and Y is formed and the chip on which a group of nozzles which discharges the light ink of C, M and Y is formed. Recording is performed using these two recording heads. By performing recording in combination of the deep ink and the light ink, it is well known that an image like a photograph having no granular feeling can be recorded. Then, by increasing a group of nozzles more than the number of nozzles of each color, the high-speed recording of black text is enabled. When a color image is recorded, the nozzle which is equal to the number of color inks is used as the Bk nozzle for discharging the Bk ink. In this example, as the Bk nozzle, the nozzle in the same area as in the case of the Y nozzle, that is, the nozzle on the left of the Y nozzle of FIG. 20C is used.

Figure 22:
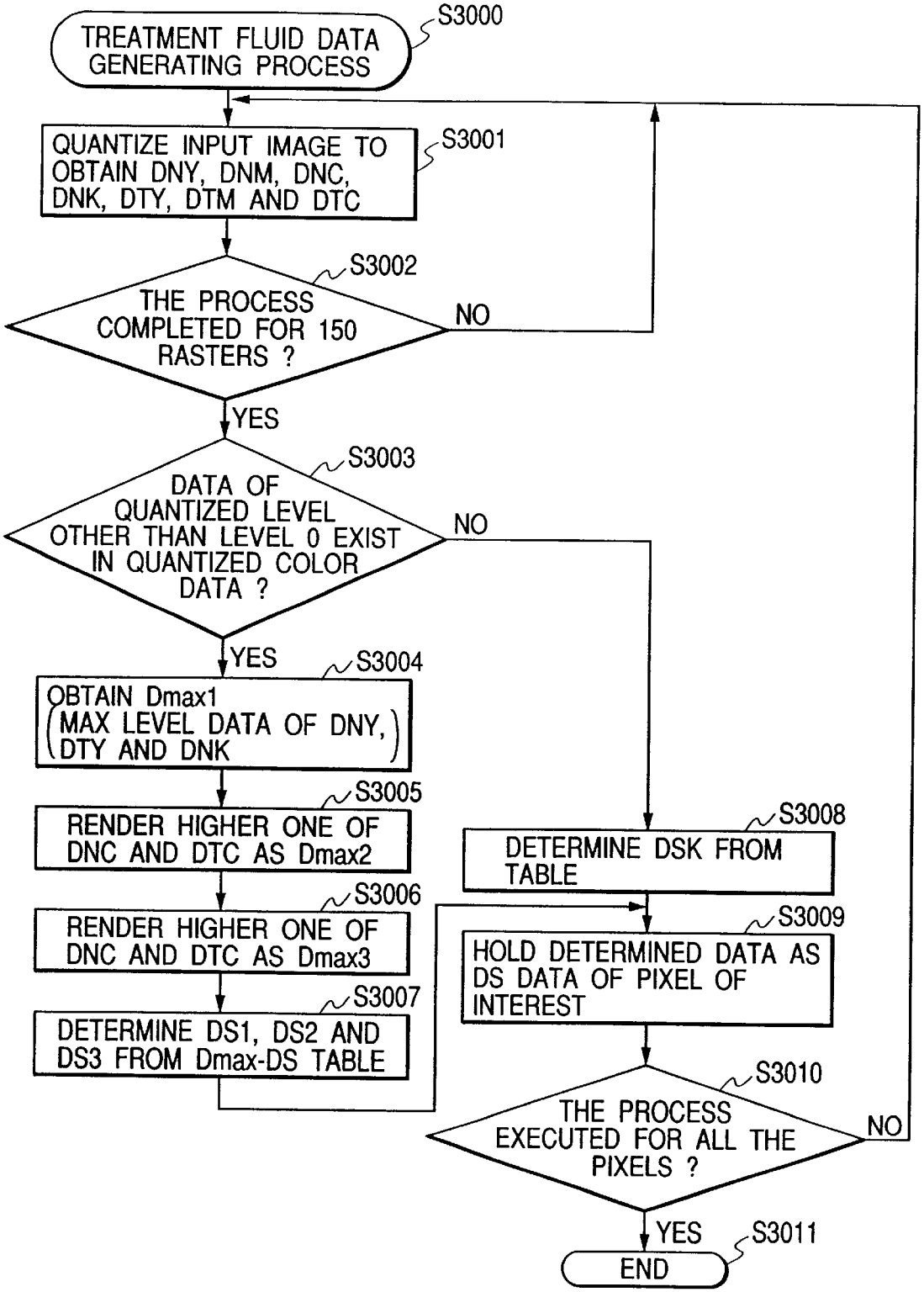
FIG. 22 is a flowchart for describing the data processing according to the sixth embodiment of the present invention.

FIG. 22 is a flowchart for describing the data generating process for the treatment fluid according to the sixth embodiment of the present invention.

First, the quantizing means 1000 quantizes the one element of an input image into the quantized data (DNY, DNM, DNC, DNK and DTY, DTM and DTC) for the deep ink and light ink of each color (Y, M, C or Bk) (S3001). The quantized level is quinary levels 0 to 4 described above. This processing is executed for a recordable raster using the Bk nozzle (S3001 and S3002). Where, because the Bk nozzle is 300 nozzles at 600 dpi, 150 rasters can be obtained by converting the input image at 300 dpi. It is decided whether or not there is such data other than DNK (data for black ink) that is not in level 0 in the quantized data (color quantized data) of each color for these 150 rasters.

(1) When there is such data other than DNK that is not in level 0 in the 150 rasters:

In this case, among the quantized data of DNK (data for black ink), DNY (data for deep yellow ink) and DTY (data for light yellow ink), the largest data is assumed to be Dmax1 (S3004). Next, in the quantized data of DNM (data for deep magenta ink) and DTM (data for light magenta ink), the larger one is assumed to be Dmax2 (S3005). Further, in the quantized data of DNC (data for deep cyan ink) and DTC (data for light cyan ink), a larger one is assumed to be Dmax3 (S3006). With reference to the Dmax—DS table of FIG. 18E, the treatment fluid data DS1, DS2 and DS3 that corresponds to Dmax1, Dmax2 and Dmax3 is generated (S3007 and S3009).

Now, as the data for the first pixel, for example, assume DNY=level 0, DNM=level 3, DNC=level 2, DNK level 0, DTY=level 1, DTM=level 2 and DTC=level 3. In this assumed example, Dmax1=level 1, Dmax2=level 2, Dmax3=level 3, DS1=level 1, DS2=level 2 and DS3=level 2.

(2) When there is a unit with data other than DNK that is not in level 0 in 150 rasters:

With reference to the table of FIG. 18D, the treatment fluid data DSK that corresponds to a value of DNK is generated (S3008).

Thus, the generated quantized data DNY, DNM, DNC, DNK, DTY, DTM and DTC of each color ink and the quantized data DS1, DS2, DS3 or DSK for the treatment fluid are developed into the matrix matter shown in FIG. 16 and based on the data, each color ink and treatment fluid are discharged from a group of the corresponding nozzles.

As described above, the present invention can also be applied to a plurality of recording heads in which a group of nozzles of each color ink is vertically configured, that is, the recording heads having such configuration shown in FIG. 20C, a high-quality photograph-tone image can be recorded, and black text and a graphics image can be recorded as a high-speed image with sufficient water resistance.

The treatment fluid which insolubilizes ink dyes can be obtained as one example as described below.

In other words, after the following components are mixed and dissolved, and further are pressurized and filtered by a membrane filter (product name: Fluoropore Filter manufactured by Sumitomo Electric Industries, Ltd.) with the pore size of 0.22 $\mu$m, treatment fluid Al can be obtained by adjusting pH to 4.8 with NaOH.

[Components of A1]

| | |
|---|---|
| Low molecular components of cationic compound | |
| stearyltrimethylammonium salt | 2.0 parts |
| (Product name; Electro Stripper QE manufactured by Kao Corp.) | |
| or, stearyltrimethylammonium chloride | |
| (Product name; Yutamine 86P manufactured by Kao Corp.) | |
| High molecular components of cationic compound | |
| Copolymer of diallylamine hydrochloric acid salt and sulfur dioxide | 3.0 parts |
| (Average molecular weight; 5,000) | |
| (Product name; Polyamine Sulfone PAS-92 manufactured by Nitto Boseki Co., Ltd.) | |
| thiodiglycol | 10 parts |
| Water | Balance |

Further, the following examples can be given as examples suitable for the ink which is insolubilized by mixing aforementioned treatment fluid.

In other words, after the following components are mixed, and further are pressurized and filtered by a membrane filter (product name: Fluoropore Filter manufactured by Sumitomo Electric Industry, Ltd.) with the pore size of 0.22 $\mu$m, inks Y1, M1, C1 and K1 of yellow, magenta, cyan and black can be obtained.

| | |
|---|---|
| C.I. Direct Yellow 142 | 2 parts |
| thiodiglycol | 10 parts |
| Product name; Acetylenol EH | 0.05 parts |
| (Manufactured by Kawaken Fine Chemical Co., Ltd.) | |
| Water | Balance |

The same composition as in Y1 except that dyes are replaced with C.I. Acid Blue 9; 2.5 parts K1

The same composition as in Y1 except that dyes are replaced with C.I. Food Black 2; 3 parts Besides, when the present invention is executed, the ink to be used is not restricted to dye ink in particular but it can also use the pigment ink in which a pigment is dispersed and the treatment fluid in which the pigment is flocculated. The following example can be given as one example of the pigment ink that causes flocculation by mixing aforementioned colorless fluid A1. In other words, as described below, the respective color inks Y2, M2, C2 and K2 of yellow, magenta, cyan, and black including each pigment and anionic compound can be obtained.

Black Ink K2

Using anion-system high polymer P-1 (styrene-methacrylic acid-metylmethacrylate, acid value of 400, weight average molecular weight of 6,000, aqueous solution containing 20% solid component, neutralizing agent: potassium hydroxide) as a dispersing agent, dispersion treatment is performed for three hours by preparing the following materials in a batch type vertical sand mill (manufactured by Aimex Corp.), filling glass beads of 1 mm in diameter as media, and cooling them in water. The viscosity after dispersion 9 cp and pH is 10.0. Carbon black dispersion of 100 nm weight average particle diameter is produced by applying this dispersing agent to a centrifugal separator and removing rough particles.

| (Composition of carbon black dispersion) | |
|---|---|
| P-1 aqueous solution (20% solid content) | 40 parts |
| Carbon black | 24 parts |
| (Product name; Mogul L manufactured by Cablark Co., Ltd.) | |
| glycerin | 15 parts |
| ethyleneglycol monobutyl ether | 0.5 part |
| isopropyl alcohol | 3 parts |
| Water | 135 parts |

Then, the black ink K2 for ink jet containing the pigment is obtained by fully dispersing the dispersion obtained above. The solid content of a finally prepared product is about 10%.

Yellow Ink Y2

Using anion-system high polymer P-2 (styrene-methacrylic acid-metylmethacrylate, acid value of 280, weight average molecular weight of 11,000, aqueous solution containing 20% solid content, neutralizing agent: diethanolamine) as a dispersing agent, dispersion treatment is performed in the same manner as in the case where black K2 is prepared and the yellow dispersion of 103 nm weight average particle diameter is produced.

| (Composition of yellow dispersion) | |
|---|---|
| P-2 aqueous solution (20% solid content) | 35 parts |
| C.I. Pigment Yellow 180 | 24 parts |
| (Product name; Novaborm Yellow PH-G manufactured by Hoechst Aktiengesellschaft) | |
| triethyleneglycol | 10 parts |
| diethyleneglycol | 10 parts |
| ethyleneglycol monbutyl ether | 1.0 part |
| isopropyl alcohol | 0.5 part |
| Water | 135 parts |

The yellow ink Y2 for ink jet containing the pigment is obtained by fully dispersing the yellow dispersion obtained above. The solid content of a finally prepared product is about 10%.

Cyan Ink C2

Using the anion system high polymer P-1 used when the black ink K2 is prepared as a dispersing agent and the following materials, the cyan color dispersion of weight average particle diameter of 120 nm is prepared by performing the same dispersion treatment as in the case of the carbon black dispersion described above.

| (Composition of cyan color dispersion) | |
|---|---|
| P-1 aqueous solution (20% solid content) | 30 parts |
| C.I. Pigment Blue 15: 3 (Product name; Fastgenble-FGF manufactured by Dainippon Ink and Chemicals, Inc.) | 24 parts |
| Glycerin | 15 parts |
| diethyleneglycol monobutyl ether | 0.5 part |
| isopropyl alcohol | 3 parts |
| Water | 135 parts |

The cyan ink C2 for ink jet containing the pigment is obtained by fully agitating the cyan color dispersion obtained above. The solid content of a finally prepared product is about 9.6%.

Magenta Ink M2

Using the anion system high polymer P-1 used when the black ink K2 is prepared as a dispersing agent and the following materials, the magenta color dispersion of weight average particle diameter of 115 nm is prepared by performing the same dispersion treatment as in the case of the carbon black dispersion described above.

| (Composition of magenta color dispersion) | |
|---|---|
| P-1 aqueous solution (20% solid content) | 20 parts |
| C.I. Pigment Red 122 (Manufactured by Dainippon Ink and Chemicals, Inc.) | 24 parts |
| Glycerin | 15 parts |
| isopropyl alcohol | 3 parts |
| Water | 135 parts |

The magenta ink M2 for ink jet containing the pigment is obtained by fully dispersing the magenta color dispersion obtained above. The solid content of a finally prepared product is about 9.2%.

In the mixture of each treatment fluid (fluid component) and ink described above, the present invention mixes aforementioned treatment fluid and ink at the position where they are permeated on a printed material or in the printed material, and consequently, among cationic substances contained in the treatment fluid as the first stage of reaction, a component with low molecular weight, soluble dyes having anionic radical used in cationic oligomer and ink, or anionic compound used in the pigment ink cause an association due to ionic interaction and instantaneously cause separation from the solution phase. As a result, in the pigment ink, dispersion destruction occurs and an aggregate of the pigment is produced.

Next, as the second stage of reaction, because an association body of aforementioned dyes and low molecular cationic substance or cationic oligomer or the aggregate of the pigment is adsorbed by the high polymer contained in the treatment fluid, the size of the aggregate of dyes generated in the association or the aggregate of the pigment becomes further larger and is difficult to insert into the gap between the fibers of a printed material, and consequently because only the fluid part separated from the solid is permeated into a recording paper, both the print quality and fixing are attained. At the same time, because the aggregate or the aggregate of the pigment formed by the low molecular component of the cationic substance or cationic oligomer, anionic dyes, and cationic substance generated by aforementioned mechanism increase their viscosity and do not move together with the movement of a fluid medium, they are not mixed even if adjacent ink dots are formed by different color ink when a full-color image is formed and no bleeding occurs. Then, aforementioned aggregate is essentially insoluble and the water resistance of a formed image becomes perfect. Further, it has also an effect that the light-resistant fastness properties of an image formed due to the screening effect of a polymer also improves.

As the insolubilization or flocculation used in this specification, its one example is only a phenomenon at aforementioned first stage and the other example is a phenomenon including both the first and second stages.

Further, when the present invention is execute, as seen in the prior art, a cationic high polymer with large molecular weight and polyvalent metal salt need not be used, or even when they need be used, they may supplementally be used to further improve the effect of the present invention, its amount used can be suppressed to the minimum. As a result, the fact that the decrease of the color development of dyes is not generated, which is a problem when the effect of water resistance is obtained using the conventional cationic high polymer and polyvalent metal salt can be given as another effect of the present invention.

A printed material used when the present invention is executed is restricted in particular, but it can suitably be plain paper such as copying paper and bond paper. It goes without saying that the printed material can suitably be coated paper manufactured for ink jet print in particular and transparent film for an OHP and can also be general high-grade paper and glossy print.

As described above, according to the present invention, the treatment fluid data is generated from the n-valued ink data and based on this data, recording is performed by the so-called matrix pattern method, whereby an electrical hardware cost is suppressed and the increase of the software processing time can be prevented. Further, sufficient water resistance and image quality can be improved by applying a sufficient amount of treatment fluid, and an increase of the running cost due to the increase of the amount of treatment fluid used and the deterioration of an image due to cockling and beading can be prevented by applying the treatment fluid more than is necessary.

III. The embodiment of the present invention to attain the third object described above is described below.

The ink jet recording apparatus used according to the following embodiments is shown in FIG. 1.

Figure 26:
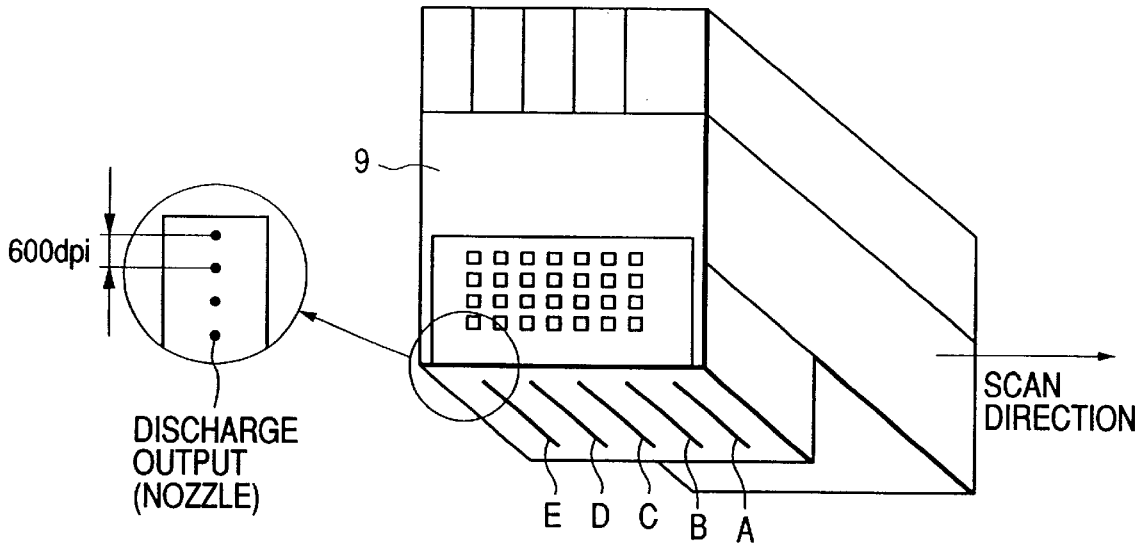
FIG. 26 is a general view of an ink jet recording head.

Further, an overview of a head 9 used in this example is shown in FIG. 26. The nozzle arrays A to E having 256 nozzles at a 600 dpi pitch are provided. A processing fluid, black ink, cyan ink, magenta ink and yellow ink are discharged from A, B, C, D and E, respectively.

Embodiment 7

Figure 27:
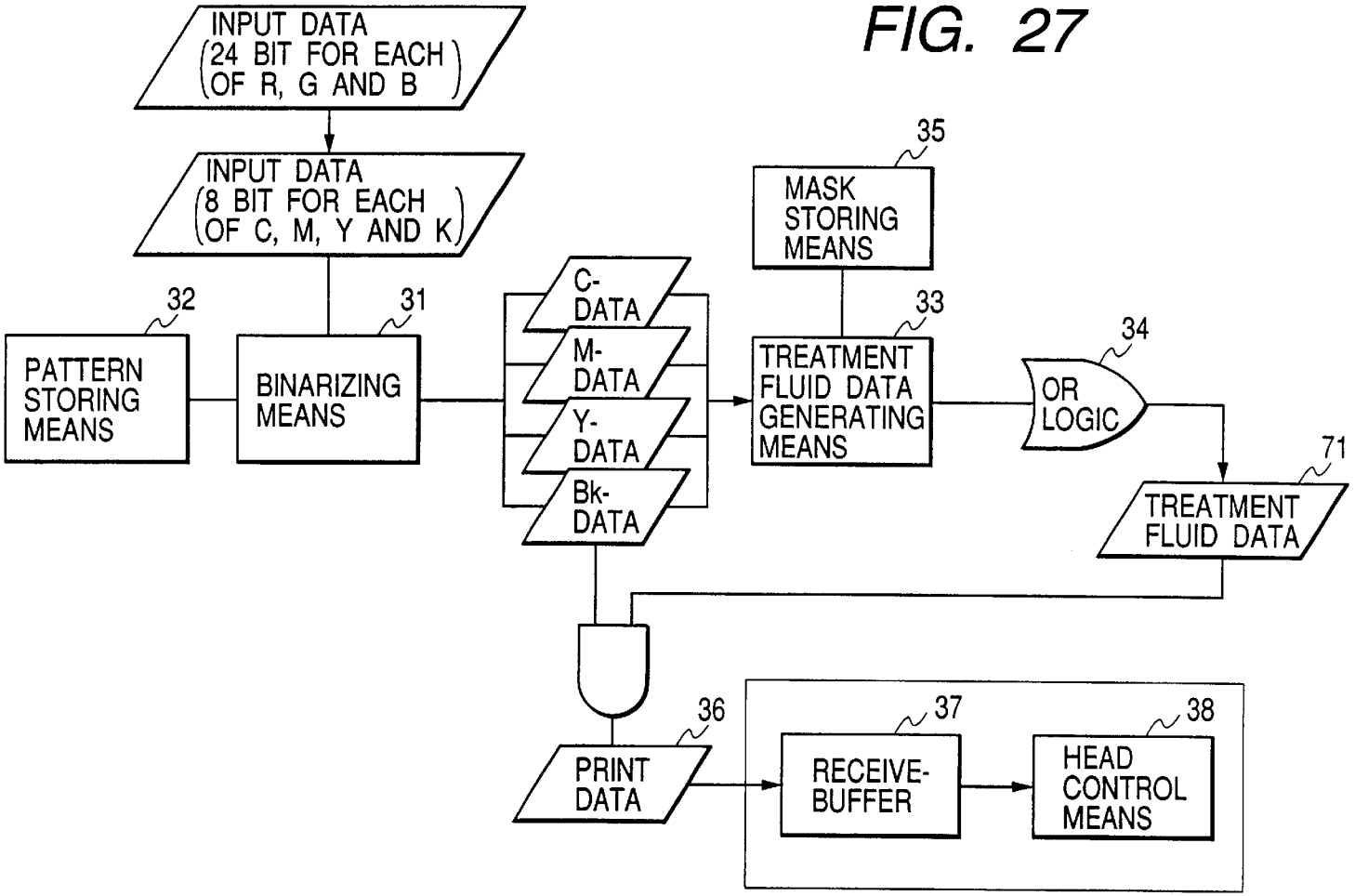
FIG. 27 is a block diagram for describing the present invention.

FIG. 27 is a block diagram for describing the present invention. The seventh embodiment of the present invention comprises a storing means which stores a binary pattern, a binary means 31 which, referring to the pattern stored by the storing means, binarizes input data to develop into the binary bit map data for each color ink, a treatment fluid data generating means 33 for generating the treatment fluid pattern of each color, an OR logic 34 which ORs the treatment fluid of each color generated by the treatment fluid data generating means, a mask storing means 35 which stores a mask used when the treatment fluid is generated, a receive-buffer 37 of a main body which receives print data 36, and a head control means 38 which drives a print head based on the data. Normally, the host computer performs the process up to the generating of print data such as the functions of the binary means and treatment fluid generating means.

In this embodiment, the 8-bit input data of each color of R, G and B having the 600 dpi resolution is converted to the 8-bit data of each color of C, M, Y, and K having 600 dpi resolution by performing brightness density conversion and color treatment, and the data is developed into the binary bit map data of each color having 600 dpi in the binary means 31 which executes binarization based on the pattern stored in the pattern storing means 32. Further, the binary treatment fluid bit map data of each color is generated from the binary bit map data of each color by the treatment fluid data generating means 33 and then the treatment fluid data of each color is ORed by the OR logic 34 and the generation of the treatment fluid data is completed. Finally, the case where the print data 36 is generated from the binary data of each color and the treatment fluid data and recording is performed based on their data is described.

FIG. 28 is an 8×8 dither pattern stored by the storing means 32. A number stored in each frame is a threshold in each pixel, and each pixel of the 8-bit input data of each color of C, M, Y, and K after performing brightness density conversion and color treatment and the density value of a dither pattern pixel are compared. When the value is larger than the threshold, the pixel 1 is set to 1 and when it is smaller than the threshold, it is set to 0. Then, the value is sequentially compared with an input image and is binarized.

Figure 29:
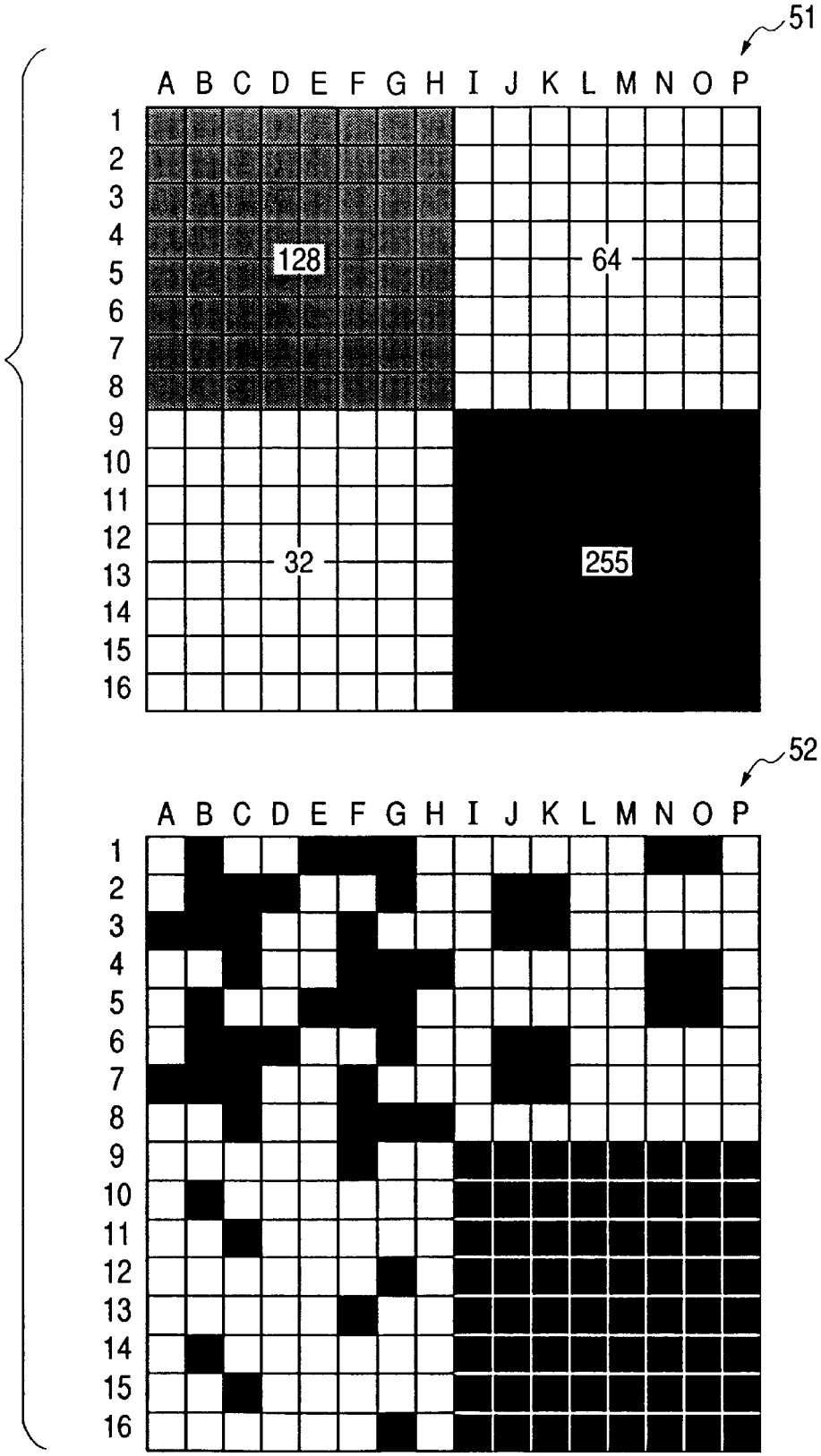
FIG. 29 is an input image and its binarized image in the description according to the seventh embodiment of the present invention.

51 of FIG. 29 is the 8-bit data of each cyan pixel after execution of brightness density conversion and color treatment. The 8×8 area from 1A to 8H has 128 density values of each pixel, the 8×8 area from II to 8P has 64 density values of each pixel, the 8×8 area from 9A to 16H has 32 density values of each pixel, and the 8×8 area from 9I to 16P has 255 density values of each pixel. Where, the data other than cyan is NULL data.

The data in which the image of 51 is binarized based on a pattern 41 (FIG. 28) by the binarizing means is shown in 52. The black part is a pixel to be printed in which data 1 is set.

The details of binarization are described below. 1A of the pattern 41 and 1A of the image 51 are compared, and because the density value is lower than a threshold, 1A of 52 becomes data 0. Then, 1B of 41 and 1B of 51 are compared, and because the result is larger than the threshold, 1B of 52 becomes data 1. When the comparison is made to 1H, the pixel 1I next to the image 51 is compared returning to 1A of the pattern 41. This operation is repeated to 8P in the same manner. Then, the image 9A of 51 is compared with the pattern 1A. Subsequently, binarization is terminated by repeating aforementioned operation and sequentially comparing the images to 16P every pixel.

Figure 30:
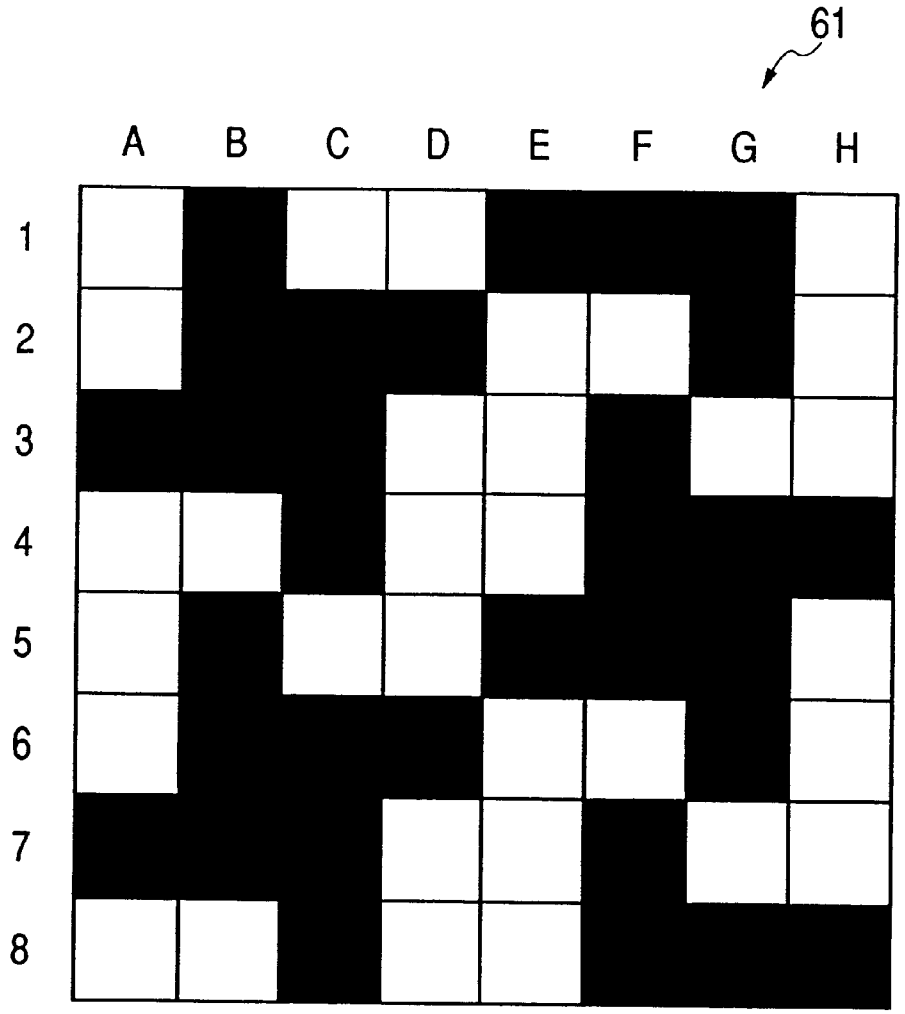
FIG. 30 is a mask pattern used by the treatment fluid generating means according to the seventh embodiment of the present invention.

FIG. 30 is an 8×8 matrix pattern 61 stored in the mask storing means 35 used in this example. It has the same matrix size as in the case of the dither pattern of FIG. 27. Here, the mask pattern is set so as to become equal to the data in which the uniform density value pattern of the 8×8 matrix pattern 128 is binarized. The black pixel is data 1.

Figure 31:
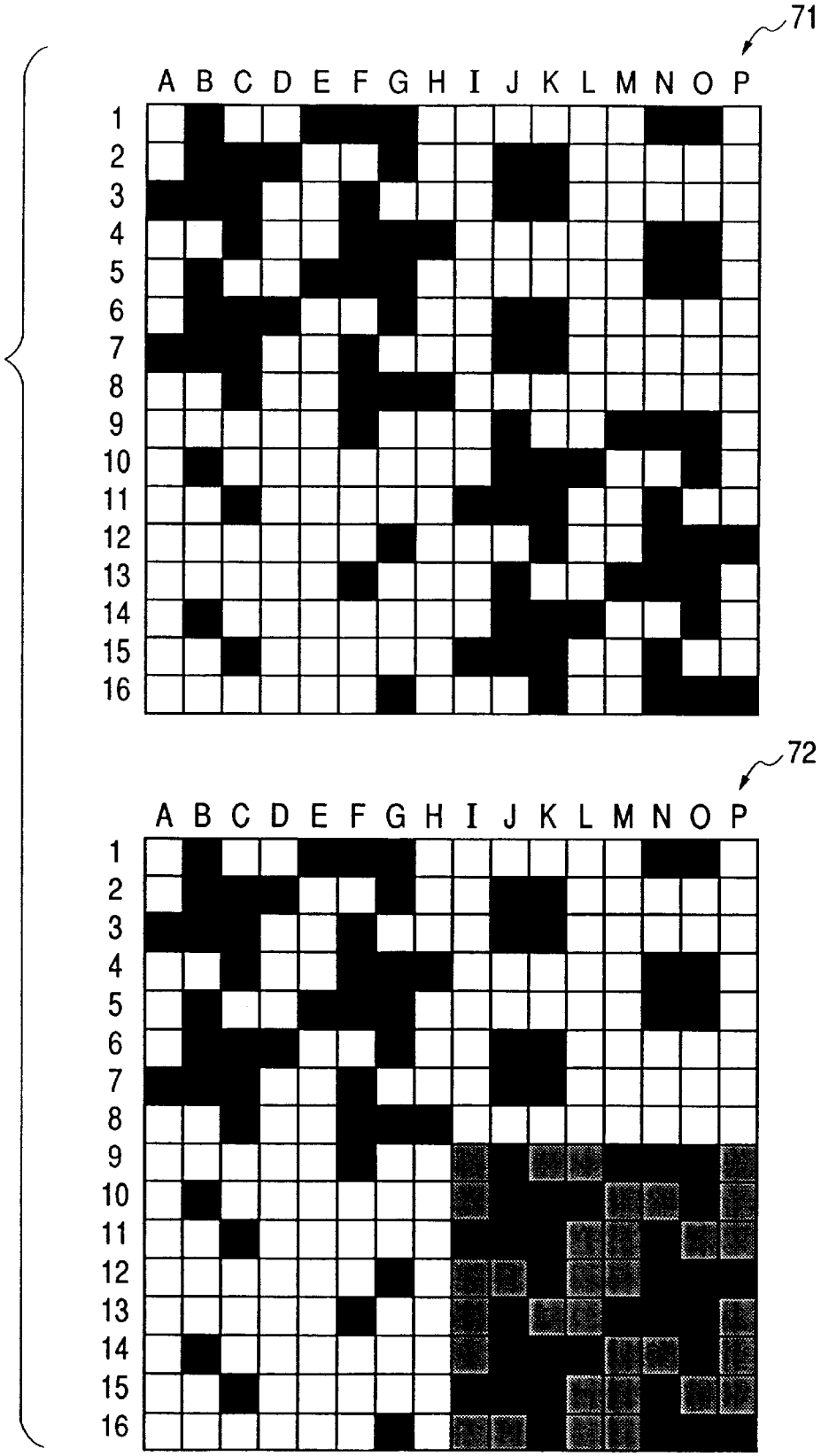
FIG. 31 is the treatment fluid data and print data used in the description according to the seventh embodiment of the present invention.

Based on the binarized cyan data 52 of FIG. 29, the generated treatment fluid data is shown in 71 of FIG. 31 using the mask pattern 61 of FIG. 30. After the image of 52 and the mask pattern of 71 are sequentially ANDed from 1A and terminated to 1H, then the column of 2A is sequentially ANDed. After the AND of the arrayis terminated to 8P by repeating this operation, the mask pattern is returned to 1A and is ANDed with the image 9A. AND is performed to 16P and the treatment fluid data generating process is completed.

72 of FIG. 31 shows the ink and treatment fluid printed to each pixel from the image data 52 and the treatment fluid data 71. The black pixel is a pixel in which the cyan and treatment fluid data exist and the gray pixel is a pixel on which only cyan is printed. As seen from 72, the treatment fluid data and cyan data exist for the area having a lower density value than 128 and the treatment fluid data is thinned for the area where the density value is high.

Figure 35:
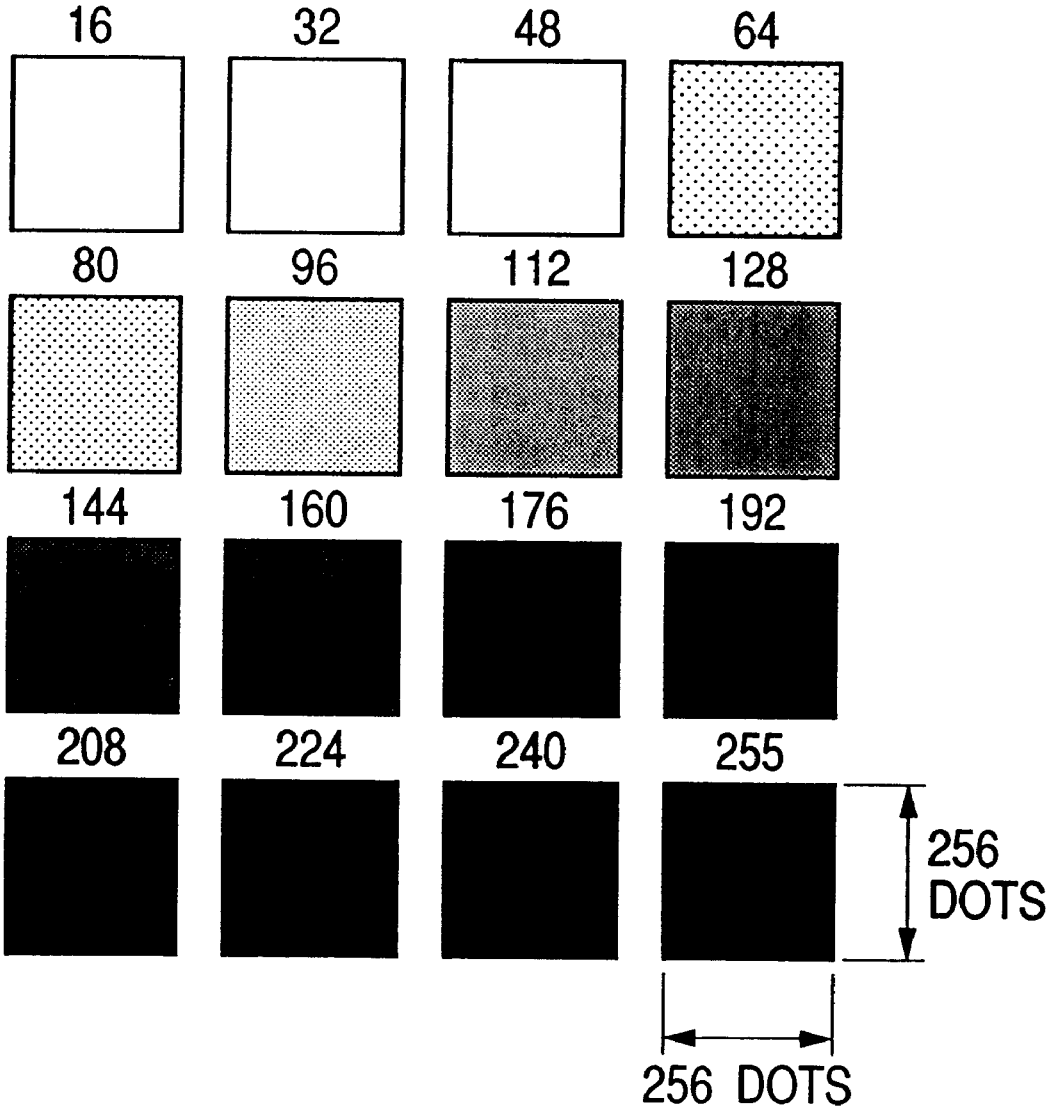
FIG. 35 is an input image used according to the seventh embodiment of the present invention.

In the same manner as in the aforementioned processing, a pattern in which a 256×256 pixel uniform pattern having each cyan density value shown in FIG. 35 is processed and printed based on the data. The number on each patch is a density value.

For one-pass and multi-pass prints, a print with uniform, sharp print with water resistance can be attained.

Further, even when the pattern shown in FIG. 36, in which the secondary and primary color solid images are adjacent and a blot occurs easily in the boundary, is printed in one pass or a multi-pass, a high-quality image with no blot is obtained.

COMPARATIVE EXAMPLE 1

Figure 32:
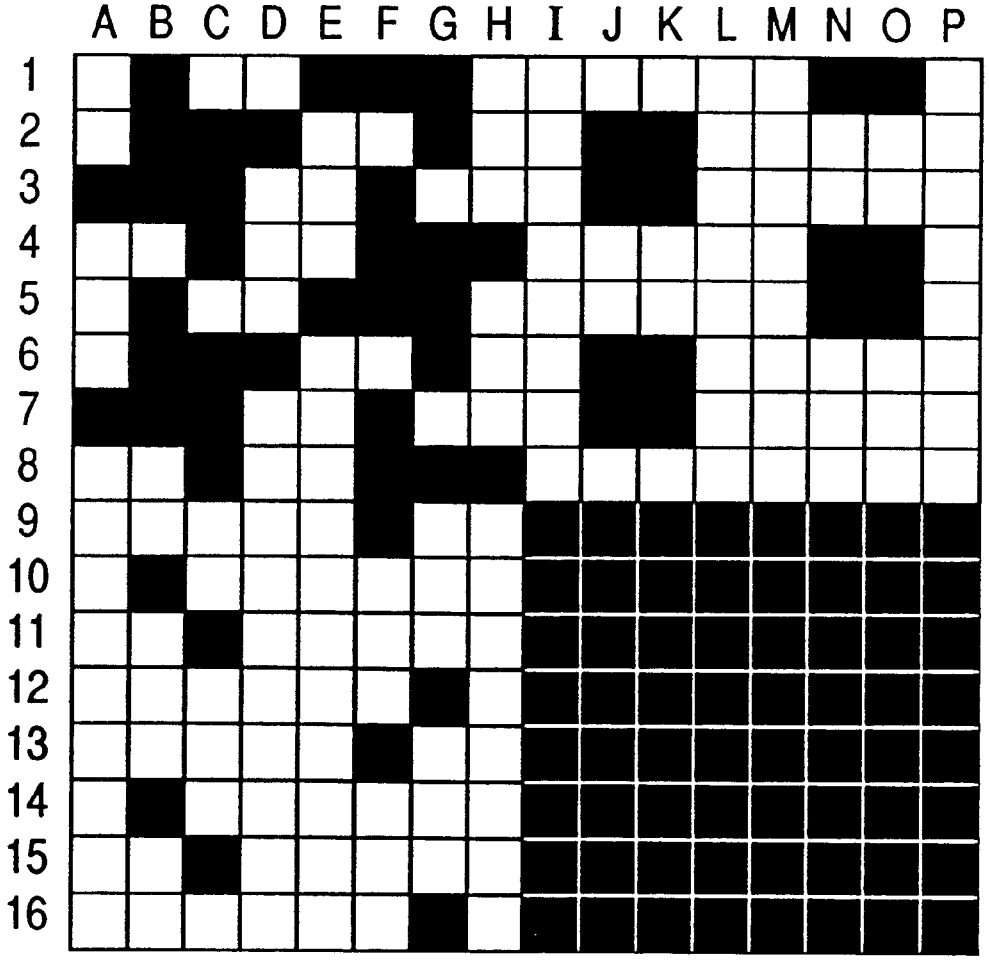
FIG. 32 is the treatment fluid data in Comparative Example 5 of the present invention.

In Embodiment 7, although the treatment fluid data is thinned by a mask for the image data, in this Comparative Example, the treatment fluid data is the data obtained by simply ORing the image data. In other words, the treatment fluid data for the image data 51 is shown in FIG. 32.

Based on aforementioned processing, a pattern in which a 256×256 pixel uniform pattern of each cyan density value is arranged shown in FIG. 35 is processed and printed based on the data. A number on a patch is a density value.

For the multi-pass print, a uniform, sharp print with water resistance is attained. When printing is performed in one pass, there is no problem regarding water resistance. However, for the quality, an uneven image (beading) short of uniformity due to the excessive application of ink in a patch with a high density value is obtained and the image quality deteriorates.

When a pattern, in which secondary and primary color solid images are adjacent and a blot occurs easily as shown in FIG. 36, is printed in one pass or a multi-pass, there is no problem regarding the boundary blot in the same manner as in Embodiment 7.

COMPARATIVE EXAMPLE 6

Figure 33:
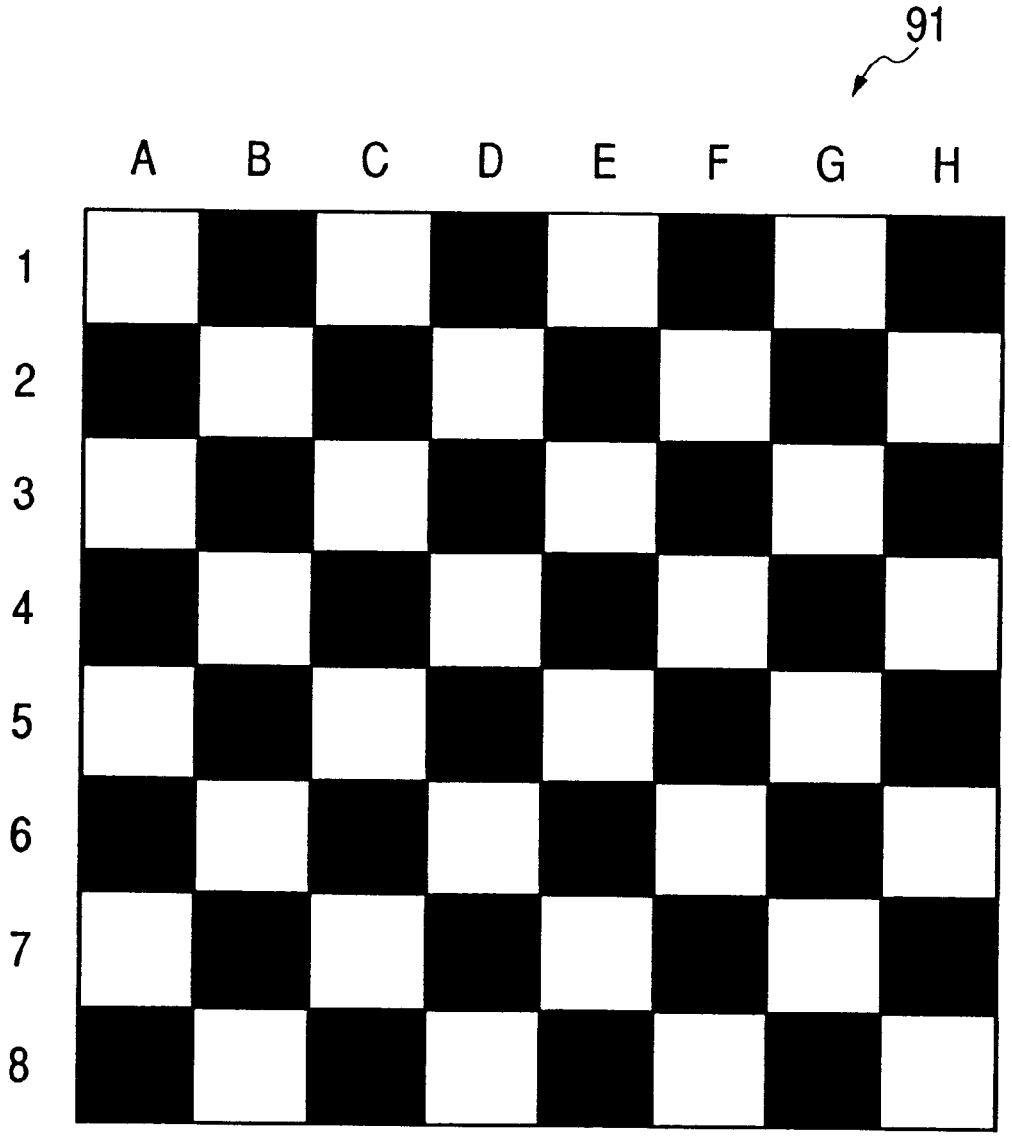
FIG. 33 is a mask pattern used by the treatment fluid generating means in Comparative Example 6 of the present invention.

FIG. 33 is an 8×8 matrix pattern stored in the mask storing means 35 used in this example. Where, the mask pattern is a fixed pattern thinned by 50% in a zigzag. When the treatment fluid data is generated from the image of 52 using this mask, the data shown in 101 of FIG. 34 is obtained.

Figure 34:
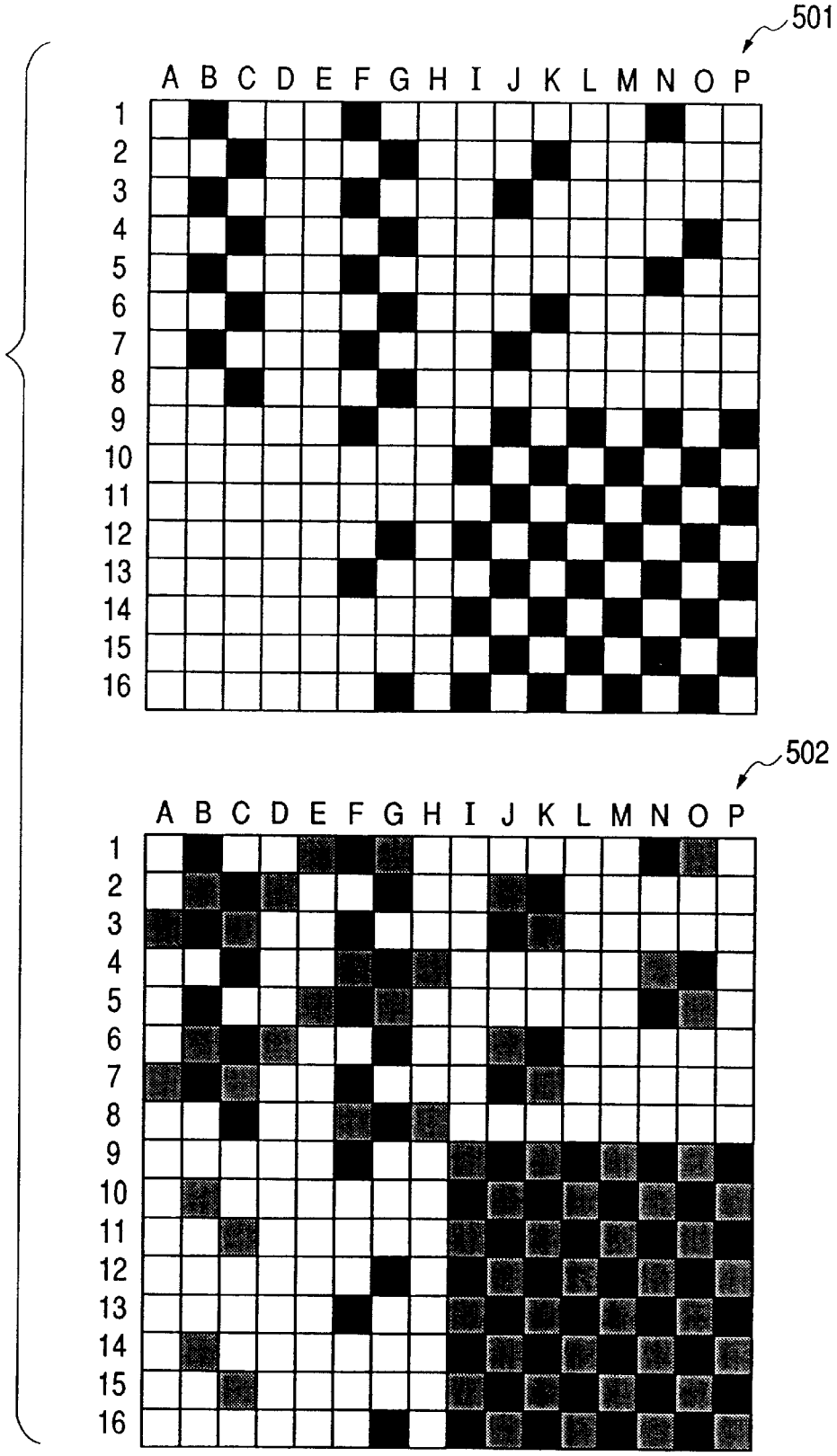
FIG. 34 is the treatment fluid data and print data used in the description of Comparative Example 6 of the present invention.

502 of FIG. 34 indicates the ink printed from the image data 52 and treatment fluid data 501 to each pixel. The black pixel is a pixel in which cyan and treatment fluid data exist and the gray pixel is a pixel in which only cyan is printed. As seen from 502, only a cyan isolated pixel occurs for the area with a low graduation like the pixel of 10B.

Based on aforementioned processing, the data shown in FIGS. 35 and 36 is processed and printed.

For the image quality and boundary blot, the same results as in Embodiment 7 are obtained without depending on the number of print passes.

However, regarding water resistance, an isolated dot occurs in a patch with a low density value and ink flows.

In this comparative example, although the treatment fluid data is generated using a zigzagged fixed mask, the same results as in Comparative Example 6 are obtained even when a random fixed mask thinned by 50% is used.

Embodiment 8

Figure 37:
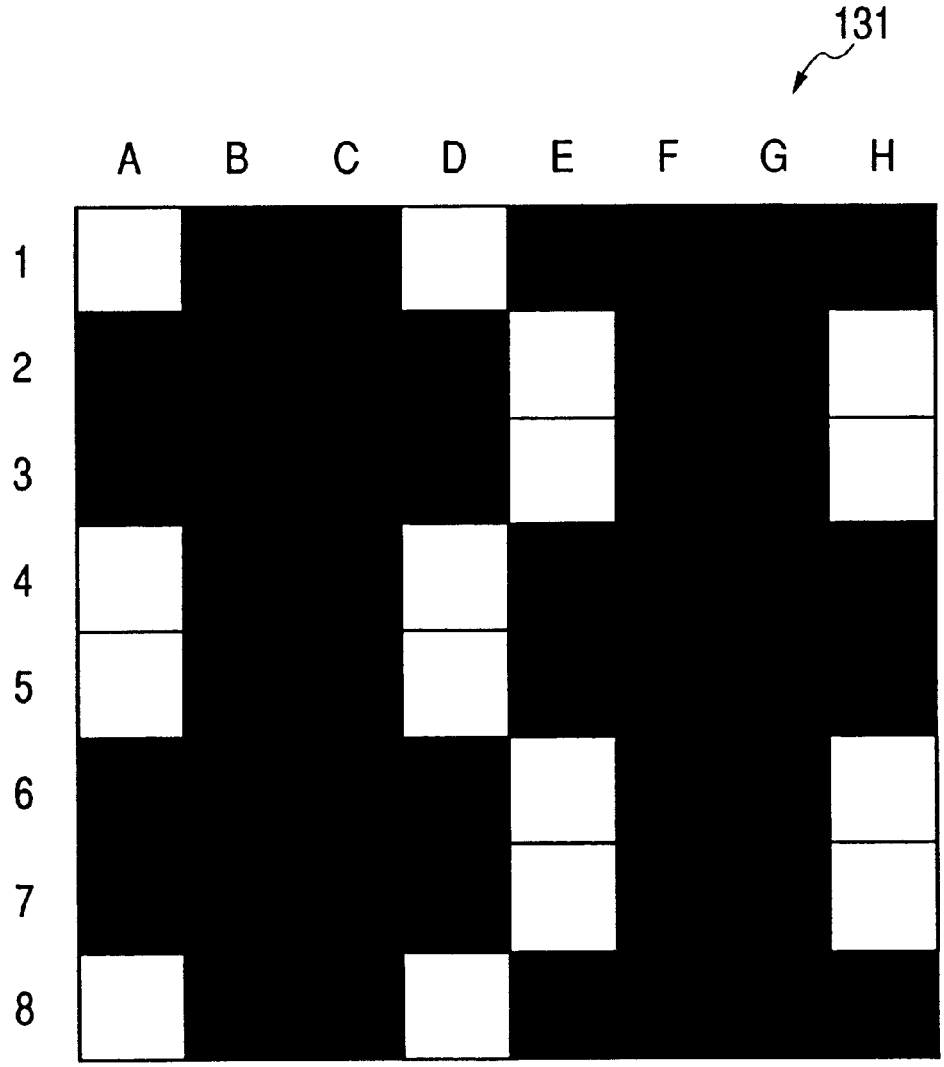
FIG. 37 is a mask pattern used by the treatment fluid generating means according to the eighth embodiment of the present invention.

Instead of the mask pattern 61 used in Embodiment 7, a mask pattern 131 shown in FIG. 37 is used. The pattern is set so as to become equal to the data in which the 8×8 uniform density value pattern of 191 is binarized. The mask pattern consists of each pixel one bit (1 or 0) and the black pixel is data 1.

Hereupon, when the pattern of FIGS. 35 and 36 is printed, the same results as in Embodiment 7 are obtained in the water resistance, image quality, and boundary blot.

In Embodiments 7 and 8, the following inks are used.

| | |
|---|---|
| (Ink which insolubilizes dyes) | |
| glycerin: | 7.0% |
| diethyleneglycol: | 5.0% |
| PAA-IL-15B (15% aqueous solution): | 24.0% |
| 50% acetic acid aqueous solution: | 7.02% |
| Cation G50 (51% aqueous solution): | 1.92% |
| butyltriglycol: | 0.95% |
| Pure water: | 54.11% |
| (Black ink) | |
| Glycerin: | 7.5% |
| thiodiglycol: | 7.5% |
| urea: | 7.5% |
| IJA 260 (10% aqueous solution. IJA 260 is a dyes name.): | 9.50% |

| | |
|---|---|
| Projet Fast Black 2 (4% aqueous solution): | 36.5% |
| Daiwa Yellow 330EP: | 0.27% |
| Direct Blue 199 (10% aqueous solution): | 7.20% |
| ammonium sulfate: | 0.45% |
| isopropyl alcohol: | 4.00% |
| Pure water: | 19.22% |
| NaOH: | 0.36% |
| (Cyan ink) | |
| Glycerin: | 7.5% |
| thiodiglycol: | 7.5% |
| urea: | 7.5% |

| | |
|---|---|
| Project Fast Cyan 1C (10% aqueous solution): | 28% |
| Acetylenol EH: | 0.1% |
| Pure water: | 44.4% |
| 50% IPA aqueous solution: | 5% |
| (Magenta ink) | |
| Glycerin: | 7.5% |
| thiodiglycol: | 7.5% |
| urea: | 7.5% |

| | |
|---|---|
| Project Fast Magenta 2C (5% aqueous solution): | 45% |
| ammonium sulfate: | 0.27% |

-continued

| | |
|---|---|
| Acetylenol EH: | 0.27% |
| 10% LiOAc (10% aqueous solution): | 1.84% |
| triethanolamine: | 0.84% |
| Pure water: | 24.43% |
| 50% IPA aqueous solution: | 5% |
| (Yellow ink) | |
| glycerin: | 7.5% |
| thiodiglycol: | 7.5% |
| urea: | 7.5% |

| | |
|---|---|
| Project Fast Yellow 2 (4.3% aqueous solution) | 52.33% |
| Daiwa Yellow 330 GR: | 0.65% |
| ammonium sulfate: | 0.25% |
| Acetylenol EH: | 0.1% |
| 4N · LiOH: | 1.88% |
| triethanolamine: | 0.74% |
| Pure water: | 16.55% |
| 50% IPA aqueous solution: | 5% |

The present invention greatly forms fluid drops using thermal energy in ink jet recording methods in particular and shows an excellent effect in ink jet methods, recording heads, and recording apparatuses which perform recording.

For its typical configuration and principle, for example, it is desirable that the basic principles disclosed in U.S. Pat. No. 4,723,129 and U.S. Pat. No. 4,740,796 be used. This method can be applied to both the so-called on demand type and continuous type systems. In particular, for the on-demand type, by applying at least one drive signal which corresponds to recording information and enables a quick temperature rise exceeding the nucleate boiling to an electricity/heat conversion element arranged corresponding to a sheet and a fluid path on which a fluid (ink) is held, the thermal energy is generated in the electricity/heat conversion element, film boiling is generated in the thermal working surface of the recording head, and consequently, a bubble in the fluid (ink) that corresponds to this drive signal one-to-one can be formed, so this method is effective. The growth and contraction of this bubble discharges the fluid (ink) via the discharge outlet and forms at least one drop. When this drive signal is formed in a pulse shape, because the growth and contraction of the bubble are performed immediately, responsive discharge of the fluid (ink) can be attained, which is desirable.

As the drive signal having this pulse shape, those signals described in U.S. Pat. No. 4,463,359 and U.S. Pat. No. 4,345,262 are suitable. If the conditions described in U.S. Pat. No. 4,313,124 regarding the temperature rise rate on the aforementioned thermal working surface are adopted, further excellent recording can be performed.

As the configuration of a recording head, in addition to the configuration (linear fluid flow path or rectangular fluid flow path) in which such discharge outlet, fluid path, and the electricity/heat conversion element are combined as disclosed in each aforementioned specification, the configurations used in U.S. Pat. No. 4,558,333 and U.S. Pat. No. 4,459,600, which disclose the configuration of the thermal working unit arranged in a bent area, may also be used.

In addition, the configuration based on the Japanese Patent Laid-Open No. Sho 59-123670 that discloses the configuration in which a common slit is the discharge outlet of the electricity/heat conversion element for a plurality of electricity/heat conversion elements and the configuration based on the Japanese Patent Application Laid-open No. 59-138461 which discloses the configuration in which an opening which absorbs the pressure wave of thermal energy can also be used.

Alternatively, an exchangeable chip type recording head, which enables electrical connection of a unit main body and supply of ink from the unit main body by being installed in the unit main body, or a cartridge type recording head, which installs an integrated ink tank in the recording head itself, can also be used.

Further, adding a recovery means and a preparatory auxiliary means to a recording head provided as the configuration of the recording apparatus of the present invention is desirable because the effect of the present invention can further be made stable. These include a capping means, cleaning means, pressurizing or absorbing means, an electricity/heat conversion element or another heating element and preparatory heating means by combinations of such, and performing the preparatory discharge mode that performs a discharge separate from recording is also effective for performing stable recording.

Furthermore, as the recording mode of a recording apparatus, by configuring recording heads in one body or combining a plurality of recording heads, a unit for performing at least one recording mode of a plurality of different colors or a full color by mixed colors or a unit for performing the recording mode using only a primary color such as black can also be used.

In the execution example of the present invention described above, although ink is described as a fluid, in general, because it is solidified at room temperature or below it, softened at room temperature or is a fluid or in aforementioned ink jet method, its temperature is controlled so that the viscosity of ink can be set with the stable discharge range by adjusting the temperature of the ink itself within the range exceeding 30° C. and 70° C., the ink may be liquefied when a recording signal to be used is issued.

In addition, the temperature rise due to thermal energy can be positively prevented by using it as the energy of a state change from the solid state of ink to the liquid state or the ink can be stored in a solid state for prevention of ink evaporation. The use of the ink with the property in which it is first liquefied by thermal energy, such as the ink which is discharged as liquefied ink or the use of the ink which starts being solidified when it reaches a recording medium, can also be applied to the prevent invention. In such case, ink may be held in recesses or through-holes in a porous sheet as a liquefied or solid substance or be opposed to an electricity/heat conversion element as described in Japanese Patent Application Laid-open No. 54-56847 or Japanese Patent Application Laid-open No. 60-71260. In the present invention, the most effective method for each ink described above is to execute the film boiling method described above.

As described above, use of a recording apparatus based on the present invention can provide an ink jet recording apparatus which can improve sufficient water resistance and picture quality by generating the treatment fluid data from the ink data binarized according to a pattern and printing-it, and applying a sufficient amount of treatment fluid, and which can prevent the increase of the running cost due to the increase of the amount of treatment fluid used and the deterioration of the picture quality due to the cockling and beading by avoiding the application of the treatment fluid more than is necessary.

What is claimed is:

1. An ink jet recording method in an ink jet recording apparatus, comprising:

a first head having a discharge outlet for discharging a first ink having a first color;

a second head having a discharge outlet for discharging a second ink having a same color as said first color; and a third head having a discharge outlet for discharging a treatment fluid which insolubilizes said first ink and said second ink, wherein when an image is formed by discharging ink or treatment fluid in the order of said first head, said third head and said second head to an area where recording is performed according to image data, the application amount X1 of the first head for said area and the application amount X2 of said second head for said area are set to X1<X2 or X1>X2.

2. The ink jet recording method according to claim 1, wherein by thinning said image data based on a fixed pattern, the application amount X1 of said first head or the application amount X2 of said second head is decreased.

3. The ink jet recording method according to claim 1, wherein the discharge amount of the discharge outlet for discharging said first ink or the discharge amount of the discharge outlet for discharging said second ink is decreased.

4. The ink jet recording method according to claim 1, wherein the discharge outlet for discharging said first ink, the discharge outlet for discharging said second ink, and the discharge outlet for discharging said treatment fluid use thermal energy to cause a bubble in each ink or treatment fluid and to discharge the ink or treatment fluid by pressure of the bubble.

5. An ink jet recording method according to claim 1, further comprising the steps of:

generating treatment fluid quantized data based on ink quantized data n-valued at a predetermined resolution;

allocating ink data and treatment fluid data using a matrix consisting of a plurality of pixels in accordance with said ink quantized data and said treatment fluid quantized data;

controlling discharge of ink by said first and second heads for a pixel subject to allocation, based on said allocated ink data; and controlling the discharge of said treatment fluid by said third head for a pixel subject to allocation, based on said allocated treatment fluid data.

6. An ink jet recording apparatus, comprising:

a first head having a discharge outlet for discharging a first ink having a first color;

a second head having a discharge outlet for discharging a second ink having a same color as said first color; and a third head having a discharge outlet for discharging a treatment fluid which insolubilizes said first ink and said second ink, wherein when an image is formed by discharging ink or treatment fluid in the order of said first head, said third head, and said second head to an area where recording is performed according to image data, the application amount X1 of the first head for said area and the application amount X2 of said second head for said area are set to X1<X2 or X1>X2.

7. The ink jet recording apparatus according to claim 6, wherein by thinning said image data based on a fixed pattern, the application amount X1 of said first head or the application amount X2 of said second head is decreased.

8. The ink jet recording apparatus according to claim 6, wherein the discharge amount of the discharge outlet for discharging said first ink or the discharge amount of the discharge outlet for discharging said second ink is decreased.

9. The ink jet recording method according to claim 6, wherein the discharge outlet for discharging said first ink, said discharge outlet for discharging said second ink, and said discharge outlet for discharging said treatment fluid use thermal energy to cause a bubble in each ink or treatment fluid and to discharge the ink or treatment fluid by pressure of the bubble.

10. The ink jet recording apparatus according to claim 6, further comprising:

means for generating treatment fluid quantized data based on ink quantized data n-valued at a predetermined resolution;

means for allocating ink data and treatment fluid data using a matrix composed of plural pixels, based on said ink quantized data and said treatment fluid quantized data;

first control means for controlling the discharge of said first and second inks by said first and second heads for a pixel subject to allocation, based on said ink data allocated by said allocating means; and second control means for controlling the discharge of said treatment fluid by said third head for a pixel subject to allocation, based said treatment fluid data allocated by said allocating means.

11. The ink jet recording apparatus according to claim 10, wherein said treatment fluid quantized data generating means generates the treatment fluid quantized data based on the n-valued ($n \geqq 3$) ink quantized data, and wherein said allocating means allocates said ink data and said treatment fluid data using a matrix consisting of a plurality of pixels of L (integer$\geqq$2) by M (integer $\geqq$2) in accordance with said ink quantized data and said treatment fluid quantized data.

12. The ink jet recording apparatus according to claim 10, wherein said first and second heads discharge a plurality of different inks, and wherein said ink quantized data is multiply configured in accordance with the number of said multiple inks.

13. The ink jet recording apparatus according to claim 12, wherein said multiple inks are black ink, cyan ink, magenta ink and yellow ink.

14. The ink jet recording apparatus according to claim 12, wherein said treatment fluid quantized data generating means generates said treatment fluid quantized data based on the largest level among the quantized data of said multiple inks.

15. The ink jet recording apparatus according to claim 12, further comprising means for converting each of said plural ink quantized data to the treatment fluid quantized data based on a predetermined conversion table to form multiple sets of treatment fluid quantized data and generating said treatment fluid data based at least two sets of treatment fluid quantized data among the multiple sets of treatment fluid quantized data.

16. The ink jet recording apparatus according to claim 15, wherein the at least two sets of treatment fluid quantized data for generating said treatment fluid data is the maximum data among the treatment fluid quantized data converted from the quantized data for cyan ink, magenta ink and yellow ink and the treatment fluid quantized data converted from the quantized data for the black ink.

17. The ink jet recording apparatus according to claim 10, further comprising:

a first move means for effecting relative reciprocal movement of said first, second and third heads and a recording medium in a main scanning direction; and a second move means for effecting relative movement of said first, second and third heads and said recording medium in a sub-scanning direction which intersects said main scanning direction, wherein said first and second heads each comprises a plurality of ink discharge outlets arrayed along the sub-scanning direction; and wherein said third head comprises a plurality of treatment fluid discharge outlets arrayed along the sub-scanning direction.

18. The ink jet recording apparatus according to claim 17, wherein said first and second heads each comprises a plurality of arrays of said ink discharge outlets in parallel and discharge different inks from the ink discharge outlets of different arrays, wherein said third head comprises an array of said treatment fluid discharge outlets in parallel with the arrays of said ink discharge outlets, and wherein said treatment fluid quantized data generating means generates said treatment fluid quantized data based on the maximum level among quantized data of multiple inks.

19. The ink jet recording apparatus according to claim 17, wherein said treatment fluid discharge outlets of said third head are arranged at positions corresponding to said ink discharge outlets of said first and second heads.

20. The ink jet recording apparatus according to claim 17, wherein said first and second heads each comprise said plurality of ink discharge outlets which discharge different inks in one line, and wherein said treatment fluid discharge outlets of said third head are arranged at positions corresponding to said ink discharge outlets in said main scanning direction.

21. The ink jet recording apparatus according to claim 10, wherein said first, second and third heads each comprise a plurality of chips.

22. The ink-jet recording apparatus according to claim 10, wherein said first, second and third heads each comprise electrothermal conversion elements which generate thermal energy for discharging ink and treatment fluid.

* * * * *

UNITED STATES PATENT AND TRADEMARK OFFICE

CERTIFICATE OF CORRECTION

PATENT NO. : 6,435,639 B1
DATED : August 20, 2002
INVENTOR(S) : Nakajima et al.

It is certified that error appears in the above-identified patent and that said Letters Patent is hereby corrected as shown below:

Column 6,
Line 5, “these” should read -- this --;
Line 12, “is” should be deleted; and
Line 41, “to-prevent” should read -- to prevent --.

Column 12,
Line 48, “to” should read -- to be --.

Column 14,
Line 22, “all” should be deleted.

Column 16,
Line 45, “receive buffer” should read -- receive-buffer --.

Column 17,
Line 45, “a discharge outlet” should read -- discharge outlets --;
Line 55, “quantize” should read -- quantizing --; and
Line 56, “quantize” should read -- quantized --.

Column 24,
Line 18, “execute,” should read -- executed, --; and
Line 47, “is” should be deleted.

Column 25,
Line 37, “II” should read -- 1I --; and
Line 46, “1A” should begin a new paragraph.

Column 26,
Line 3, “arrayis” should read -- array is --.

Column 29,
Line 58, “printing-it,” should read -- printing it, --;
Line 62, “the” (second occurrence) should be deleted; and
Line 64, “is” should be deleted.

Column 31,
Lines 27 and 56, “based” should read -- based on --.

UNITED STATES PATENT AND TRADEMARK OFFICE

CERTIFICATE OF CORRECTION

PATENT NO. : 6,435,639 B1
DATED : August 20, 2002
INVENTOR(S) : Nakajima et al.

It is certified that error appears in the above-identified patent and that said Letters Patent is hereby corrected as shown below:

Column 32,
Lines 42, 49 and 52, “comprise” should read -- comprises --.

Signed and Sealed this

Twenty-fifth Day of March, 2003

JAMES E. ROGAN
*Director of the United States Patent and Trademark Office*